US009238370B2

(12) United States Patent
Teramoto et al.

(10) Patent No.: US 9,238,370 B2
(45) Date of Patent: Jan. 19, 2016

(54) LIQUID ACCOMMODATING CONTAINER

(71) Applicant: Seiko Epson Corporation, Tokyo (JP)

(72) Inventors: Ryosuke Teramoto, Matsumoto (JP); Tadahiro Mizutani, Shiojiri (JP); Shun Oya, Matsumoto (JP); Akio Ito, Matsumoto (JP); Hideo Shimamura, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/745,834

(22) Filed: Jun. 22, 2015

(65) Prior Publication Data

US 2015/0367647 A1 Dec. 24, 2015

(30) Foreign Application Priority Data

Jun. 23, 2014 (JP) ..... 2014-127926
Jun. 12, 2015 (JP) ..... 2015-119000

(51) Int. Cl.
*B41J 2/175* (2006.01)

(52) U.S. Cl.
CPC ..... *B41J 2/17553* (2013.01)

(58) Field of Classification Search
USPC ..... 347/84–87, 89, 95, 100, 6, 7
See application file for complete search history.

(56) References Cited

U.S. PATENT DOCUMENTS 6,817,706 B2 * 11/2004 Hou ..... B41J 2/17513 347/86
8,469,499 B2 * 6/2013 Rittgers ..... B41J 2/17513 347/86
2002/0167570 A1 * 11/2002 Udagawa ..... B41J 2/17513 347/85
2004/0080590 A1 * 4/2004 Jung ..... B41J 2/17513 347/87
2009/0290004 A1 11/2009 Fukushima et al.

FOREIGN PATENT DOCUMENTS

JP 2009-279872 A 12/2009
JP 2010-037460 A 2/2010

* cited by examiner

*Primary Examiner* — Kristal Feggins
(74) *Attorney, Agent, or Firm* — Harness, Dickey & Pierce, P.L.C.

(57) ABSTRACT

A liquid accommodating container in which a fiber member and a liquid are accommodated has a fiber ratio of the fiber member is 5% or more to 30% or less, a fiber diameter of the fiber member is 10 μm or more to 50 μm or less, a volume average particle diameter (D50) of a pigment included in the liquid satisfies a condition of 50 nm<D50<150 nm, and a maximum particle diameter is 200 nm or less.

4 Claims, 5 Drawing Sheets

LIQUID ACCOMMODATING CONTAINER

BACKGROUND

1. Technical Field

The present invention relates to a liquid accommodating container.

2. Related Art

In the related art, a fiber absorber configured by fusing a sheath material at an intersection part of an aggregation of a double structure fiber material configured from a core material and a sheath material is known (for example, JP-A-2009-279872). For example, inks that include a surfactant with an HLB value obtained by the Griffin method of 11 or more to 18 or less and a monovalent alcohol with 8 to 12 carbon atoms is known (for example, refer to JP-A-2010-37460).

However, in cases where a fiber material with an appropriate configuration and an ink with an appropriate configuration are not combined, there is a problem were the pigment precipitates in a liquid accommodating container including a pigment ink that includes a fiber material and a pigment, thereby lowering the image quality.

SUMMARY

The invention can be realized in the following forms or application examples.

Application Example 1

According to this application example, there is provided a liquid accommodating container in which a fiber member and a liquid are accommodated where a fiber ratio of the fiber member is 5% or more to 30% or less, a fiber diameter of the fiber member is 10 μm or more to 50 μm or less, a volume average particle diameter (D50) of a pigment included in the liquid satisfies a condition of 50 nm<D50<150 nm, and a maximum particle diameter is 200 nm or less.

According to this configuration, an appropriate fiber ratio and fiber diameter in the fiber member are stipulated with respect to the fiber member and liquid accommodated in the liquid accommodating container, and because an appropriate maximum particle diameter in the pigment in the liquid is stipulated, precipitation of the pigment is suppressed. In so doing, image unevenness may be reduced and the image quality may be improved when forming an image using the liquid accommodating container. Here, the fiber ratio is the proportion of fibers occupied in a unit volume of a fiber molded body. Using the commonly used term of porosity, fiber ratio=(100%−porosity) may be represented.

According to this configuration, variations in the particle diameter of the pigment can be appropriately stipulated and precipitation of the pigment can be easily suppressed.

Application Example 2

In the liquid accommodating container according to the application example, it is preferable that the volume average particle diameter (D50) of the pigment satisfies a condition of 60 nm<D50<80 nm.

According to this configuration, variations in the particle diameter of the pigment can be reduced and precipitation of the pigment can be better suppressed.

Application Example 3

In the liquid accommodating container according to the application example, it is preferable that the pigment is configured by any of a self dispersing pigment, a resin-coated pigment coated with a dispersion rein, and a water-insoluble polymer coated pigment.

According to this configuration, since the printing suitability on ordinary paper is particularly superior, an image can be obtained in which in bleeding is suppressed.

Application Example 4

In the liquid accommodating container according to the application example, it is preferable that at least one type of organic solvent selected from glycerin, a pyrrolidone system and a glycol system is included as the liquid.

According to this configuration, precipitation of the pigment inside the liquid accommodating container can be suppressed, and the discharge stability during printing can be made favorable.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, embodiments of the invention will be described with reference to the drawings. In each drawing below, because each member is made to a visually recognizable size, the measurements of each member are different to those in practice.

Figure 1:
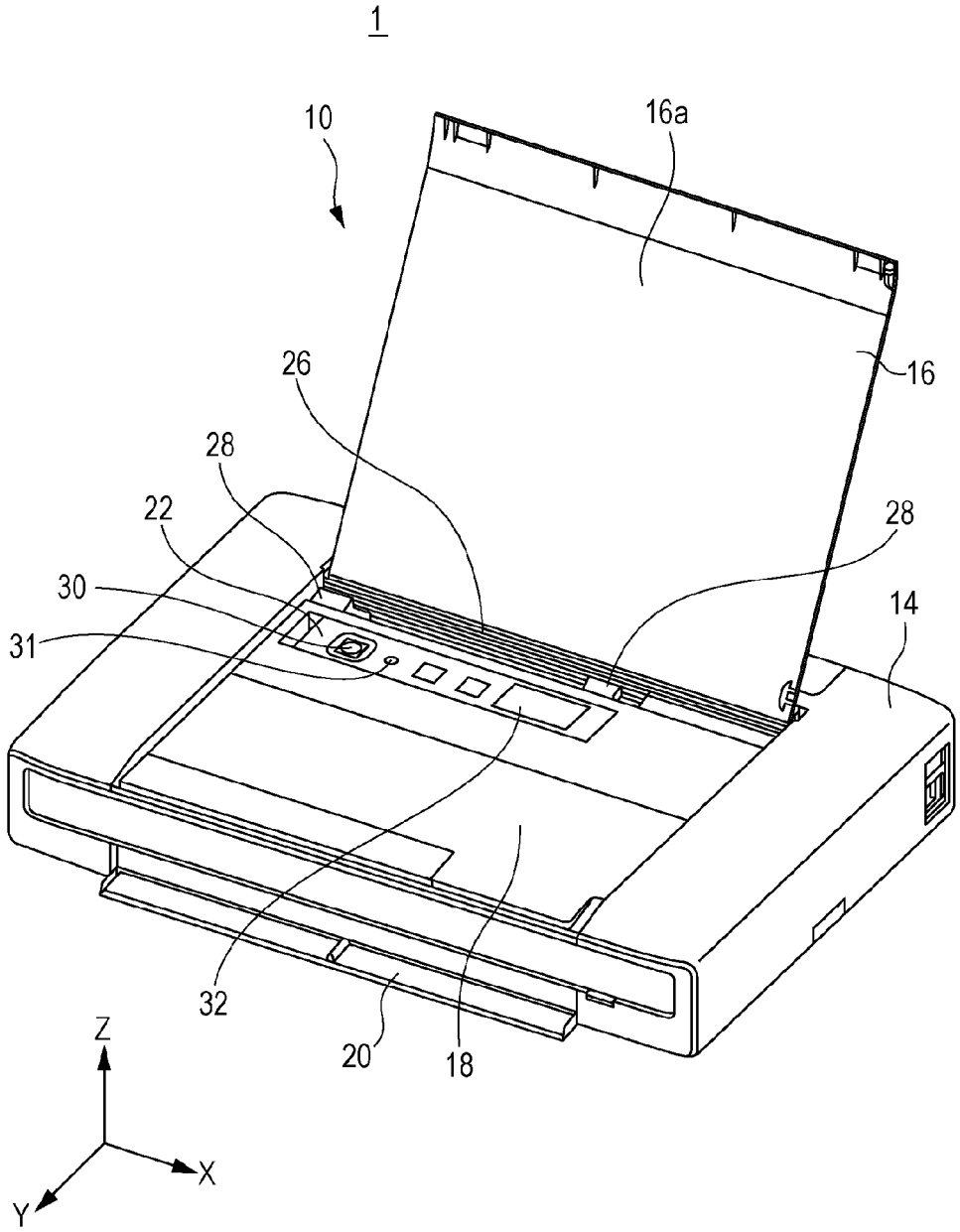
FIG. 1 is an external view showing the configuration of a liquid ejecting system.
Figure 2:
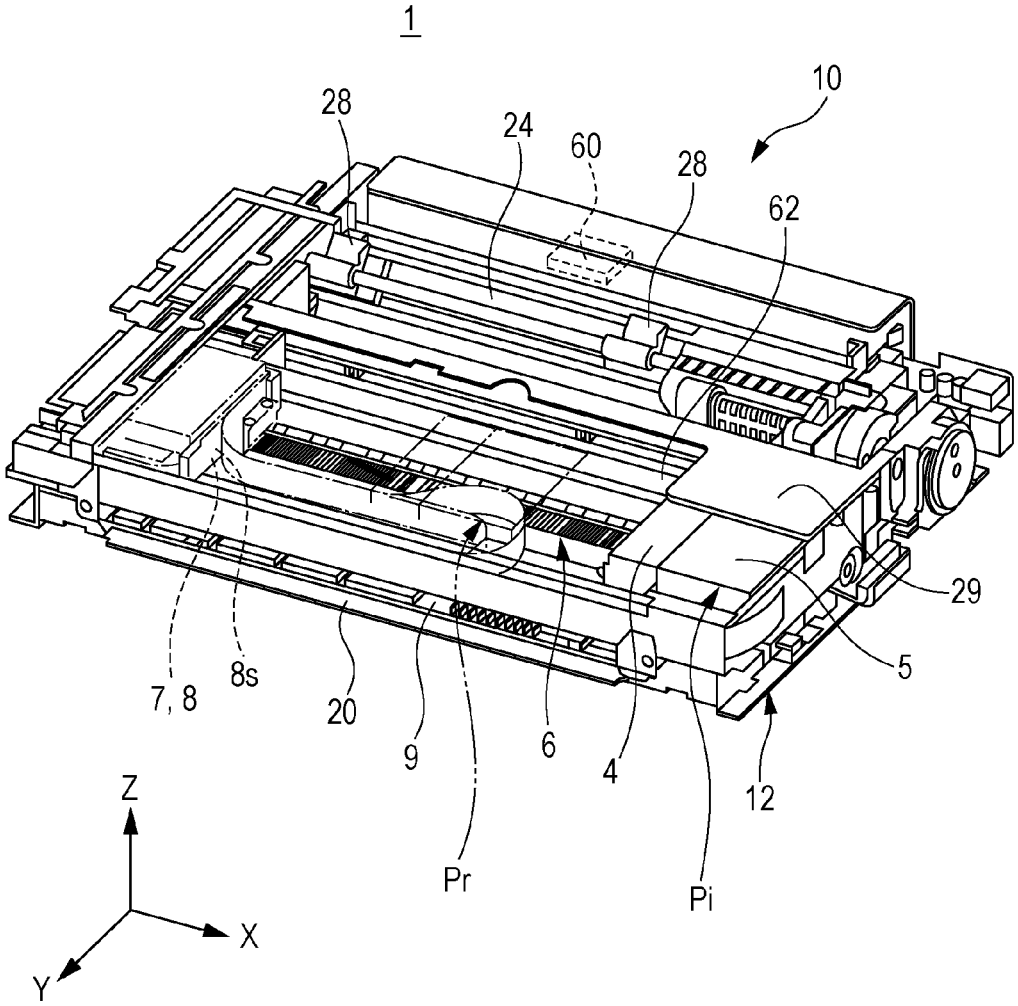
FIG. 2 is a schematic view showing the internal configuration of a liquid ejecting system.

First, the configuration of the liquid ejecting system 1 will be described. FIG. 1 is an external view showing the configuration of a liquid ejecting system 1 and FIG. 2 is a schematic view showing the internal configuration of a liquid ejecting system 1. The XYZ axes are depicted as orthogonal to one another in FIGS. 1 and 2. The X axis is the axis following the direction of the reciprocation operation of the carriage 8, described later, and is an axis following the scanning direction during printing accompanying the reciprocation of the carriage 8. The Y axis is an axis following the front to rear direction in the liquid ejecting system 1 placed horizontally on a desk or the like, and is an axis following the sub-scanning direction during printing that accompanies the reciprocation of the carriage 8. The Z axis is an axis that follows the vertical direction in the liquid ejecting system 1 placed horizontally on a desk or the like. The XYZ axes are applied, as necessary, for each drawing shown in FIG. 2 onwards. The XYZ axes in FIGS. 1 and 2 also correspond to the XYZ axes of other drawings. The liquid ejecting system 1 includes a printer 10 as a liquid ejecting apparatus and a cartridge as a liquid accommodating container. The cartridge of the embodiment accommodates ink as a liquid. In the embodiment, two types of cartridge, a first cartridge 4 and a second cartridge 5, are included. As shown in FIG. 2, in the liquid ejecting system 1 of the embodiment, the cartridges 4 and 5 are detachably mounted to a cartridge mounting portion 7 of the printer 10, and the cartridge mounting portion 7 is mounted to a carriage 8 that includes a discharging head 8*s* for ink discharge, and ordinarily is integrated with the carriage 8. Below, the cartridge 4 is referred to as the "first cartridge 4" and the cartridge 5 as the "second cartridge 5", as appropriate. The liquid ejecting system 1 of the embodiment is a small liquid ejecting system suitable to mobile use with excellent portability.

The first cartridge 4 of the embodiment accommodates a single color of ink, for example, black ink. The second cartridge 5 of the embodiment accommodates a plurality of colors of ink, and, in the embodiment, three liquid accommodation portions are divided and formed on the interior thereof. In so doing, the second cartridge 5 of the embodiment accommodates yellow, magenta, and cyan as three colors of ink.

Here, the number and type of cartridges mounted to the cartridge mounting portion 7 is not limited to the embodiment. For example, four first cartridges 4 may be prepared corresponding each color of black, cyan, magenta, and yellow inks, and these four first cartridges 4 may be mounted to the cartridge mounting portion 7. Cartridges accommodating other colors (for example, light magenta or light cyan) of ink may be mounted to the cartridge mounting portion 7. In a case of mounting a first cartridge 4 for each color of ink in this way, the second cartridge 5 may not be mounted.

The printer 10 is an ink jet printer. As shown in FIG. 1, the printer 10 includes a housing 14, a sheet supply portion cover 16, a recording portion protective cover 18, a discharge portion cover 20 and an operation portion 22. As show FIG. 2, the printer 10 includes a device main body 12.

As shown in FIG. 1, the housing 14 covers the periphery of the apparatus main body 12 and configures the external appearance of the printer 10. A sheet supply portion cover 16 is provided on the upper surface of the printer 10. The sheet supply portion cover 16 is rotatably attached to the upper surface of the housing 14. The sheet supply portion cover 16 is able to take an opened state (FIG. 1) and a closed state (not shown) with respect to the housing 14. The sheet supply portion cover 16 configures the upper surface of the housing 14 and the upper surface of the printer 10 in a case of a closed state with respect to the housing 14.

The sheet supply portion cover 16 takes an inclined state on the rear surface side (−Y direction side) of the printer 10 in a case of an opened state with respect to the housing 14. In this state, the rear surface of the sheet supply portion cover 16 functions as a sheet placement surface 16*a*. In a case where the sheet supply portion cover 16 is in the opened state with respect to the housing 14, a sheet opening portion 26 of the sheet supply portion 24, described later, of the apparatus main body 12 is in an opened state with respect to above the printer 10. Therefore, the sheet supply portion 24 is able to feed a sheet placed on the placement surface 16*a* to a feed path. The feed path is the movement path of a sheet when printing is performed. A pair of sheet guides 28 is provided on the sheet opening portion 26. The pair of sheet guides 28 configures a gap in the width direction (X axis direction) of the printer 10 to be adjustable. The pair of sheet guides 28 captures both ends in the width direction of the sheet and regulates the position of the sheet in the width direction.

In a case where the sheet supply portion cover 16 is in the opened state with respect to the housing 14, the recording portion protective cover 18 and the operation portion 22 are in an exposed state on the upper surface of the printer 10. The recording portion protective cover 18 is able to take an opened state (not shown) and a closed state (FIG. 1) with respect to the housing 14. In a case where the recording portion protective cover 18 is in an opened state with respect to the housing 14, a user is able to access the recording portion 6 provided in the apparatus main body 12.

The operation portion 22 includes, in addition to a power button 30 for operating the printer 10, a notification lamp 31, a display module 32, a printing settings button and the like. In a case where the sheet supply portion cover 16 is in an opened state with respect to the housing 14, a user is able to access the operation portion 22, and it is possible to operate the printer 10. The notification lamp is lit and extinguished by receiving control from the controller 60, and performs notification and the like of ink filling in the cartridge 4. The display module 32 is a liquid crystal display device, and receives the control of a controller 60 and displays an ink filling switch, a cartridge replacement switch and the like in addition to various items of information, for example, such as if a restriction is applied to printing because of the ink filling period of the cartridge 4 or if printing is temporarily paused.

A discharge portion cover 20 is provided on the front surface of the housing 14. The discharge portion cover 20 is rotatably attached to the front surface of the housing 14. The discharge portion cover 20 is able to take an opened state (FIG. 1) and a closed state (not shown) with respect to the housing 14. In a case where the discharge portion cover 20 is in an open state with respect to the housing 14, the discharge portion cover 20 discharges a sheet on which recording is executed from the discharge portion 9 of the apparatus main body 12 to the front of the printer 10.

As shown in FIG. 2, the apparatus main body 12 includes a sheet supply portion 24, a recording portion 6, a discharge portion 9, and a controller 60.

The controller 60 is electrically connected to the sheet supply portion 24, the recording portion 6 and the discharge portion 9, and controls the operation of each portion based on commands input from the operation portion 22. The controller 60 controls the movement (X axis direction movement: main scanning driving) of the carriage 8 via a carriage driving motor (not shown) and the rotation (sub-scanning driving) of a transport roller shaft (not shown) via a roller driving motor (not shown). The carriage includes a cartridge mounting portion 7 incorporated to the bottom surface thereof. The controller 60 exchanges signals with a circuit substrate provided in the cartridges 4 and 5.

The apparatus main body 12 includes a carriage guide rail 62, and the carriage 8 is movable along the carriage guide rail 62. The carriage guide rail 62 extend in the X axis direction that is in the width direction of the apparatus main body, and is incorporated to a bearing portion 409 (refer to FIG. 3) provided in the bottom surface side of the carriage 8, thereby supporting the carriage 8.

The carriage 8 with the cartridge mounting portion mounted is configured to be transportable in the width direction (X axis direction, transport direction) of the apparatus main body 12 by a carriage transport mechanism configured by the carriage driving motor and the carriage guide rail 62. By transporting the carriage 8 in the width direction of the apparatus main body 12, the cartridge mounting portion 7 moves in the width direction of the apparatus main body 12. That is, the cartridges 4 and 5 are transported in the transport direction (X-axis direction) by the printer 10. As in the embodiment, the type of printer 10 in which the cartridges 4 and 5 are mounted to a cartridge mounting portion 7 provided on the carriage 8 by which the discharging head 8*s* is moved is referred to as an "on-carriage type". An immovable cartridge mounting portion 7 may be configured at a different site to the carriage 8, and ink may be supplied from the cartridges 4 and 5 mounted to the cartridge mounting portion 7 to the discharging head of the carriage 8 via a flexible tube. Such a type of printer is also referred to as an "off-carriage type". At this time, the cartridges 4 and 5 are not limited to a detachable cartridge, and may be a fixed ink tank. An ink fill port to which ink is able to be poured from outside may be provided in the ink tank.

In the usage state of the liquid ejecting system 1, the axis following the main scanning direction (left to right direction) in which the carriage 8 is reciprocated is the X axis, the axis following the sub-scanning direction (front to rear direction) in which the sheet is transported is the Y axis, and the axis following the vertical direction (up-and-down direction) is the Z axis. The upward vertical direction is the +Z axis direction and the downward vertical direction is the −Z axis direction. The usage state of the liquid ejecting system 1 is a state in which the liquid ejecting system 1 installed on a horizontal surface, and in the embodiment, the horizontal surface is a surface (XY plane) parallel to the X axis and the Y axis.

As shown in FIG. 2, the carriage 8 moves along the linear transport path in the X axis direction formed by the carriage guide rail 62, and the first stop position Pi in the +X axis end side of the transport path is the carriage origin position. The apparatus main body 12 includes a cartridge cover 29 at the first stop position Pi and the cartridge cover 29 covers the cartridges 4 and 5 mounted to the carriage 8 stopped at the first stop position Pi. Thus, the cartridges 4 and 5 are not removable from the carriage 8, and more specifically from the cartridge mounting portion 7 at the first stop position Pi. In the embodiment, ink filling is executable in a state where the carriage 8 is stopped at the first stop position Pi. The carriage 8 is stopped by receiving control of the controller 60 at a predetermined stop position at which the cartridge is not covered by the cartridge cover 29 that is a position different from the first stop position Pi that is the carriage origin position, that is, the second stop position Pr in FIG. 2, and the cartridges 4 and 5 are able to be replaced at the second stop position Pr.

Figure 3:
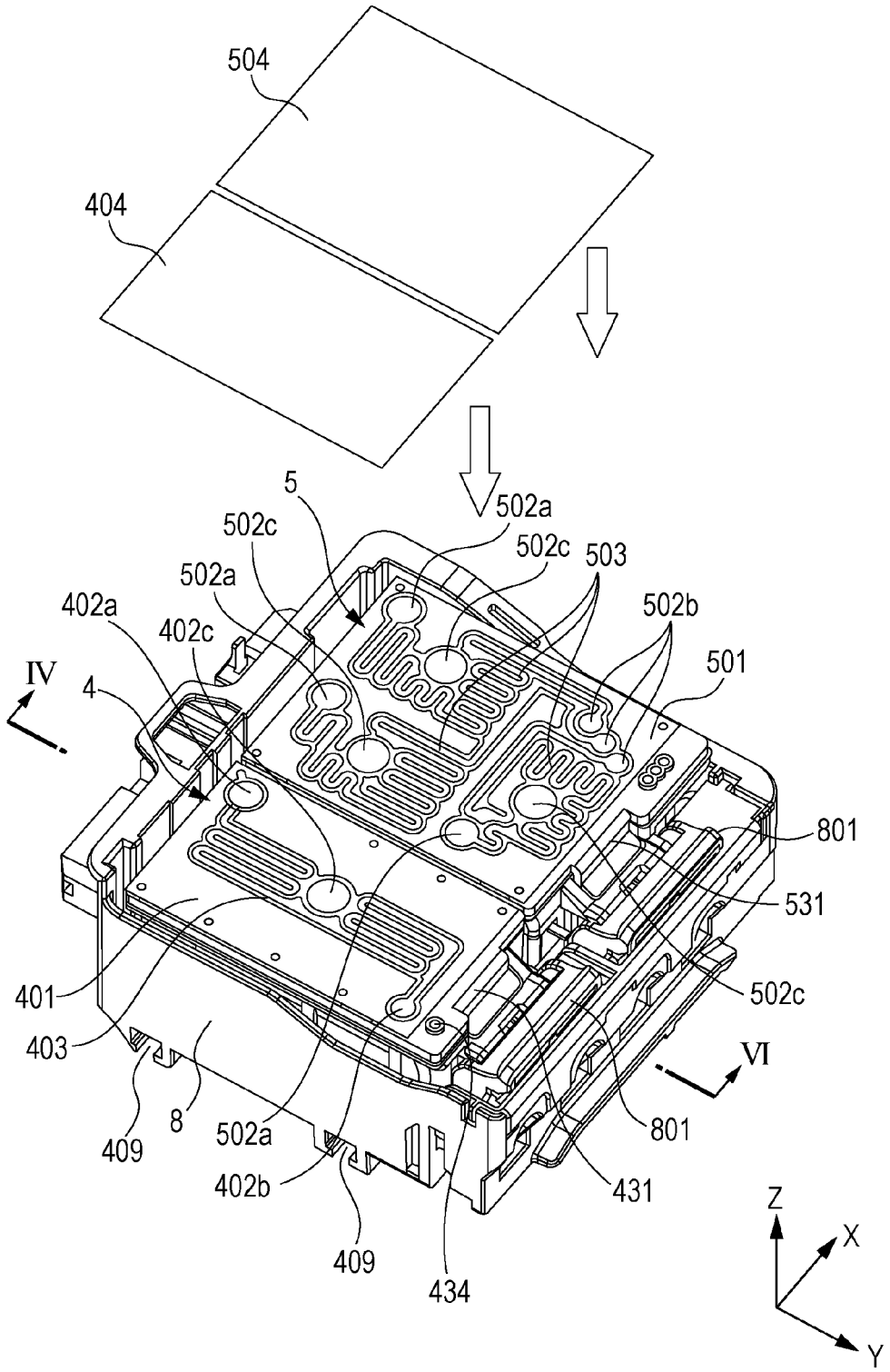
FIG. 3 is an external view showing the configuration of a cartridge (liquid accommodating container).
Figure 4:
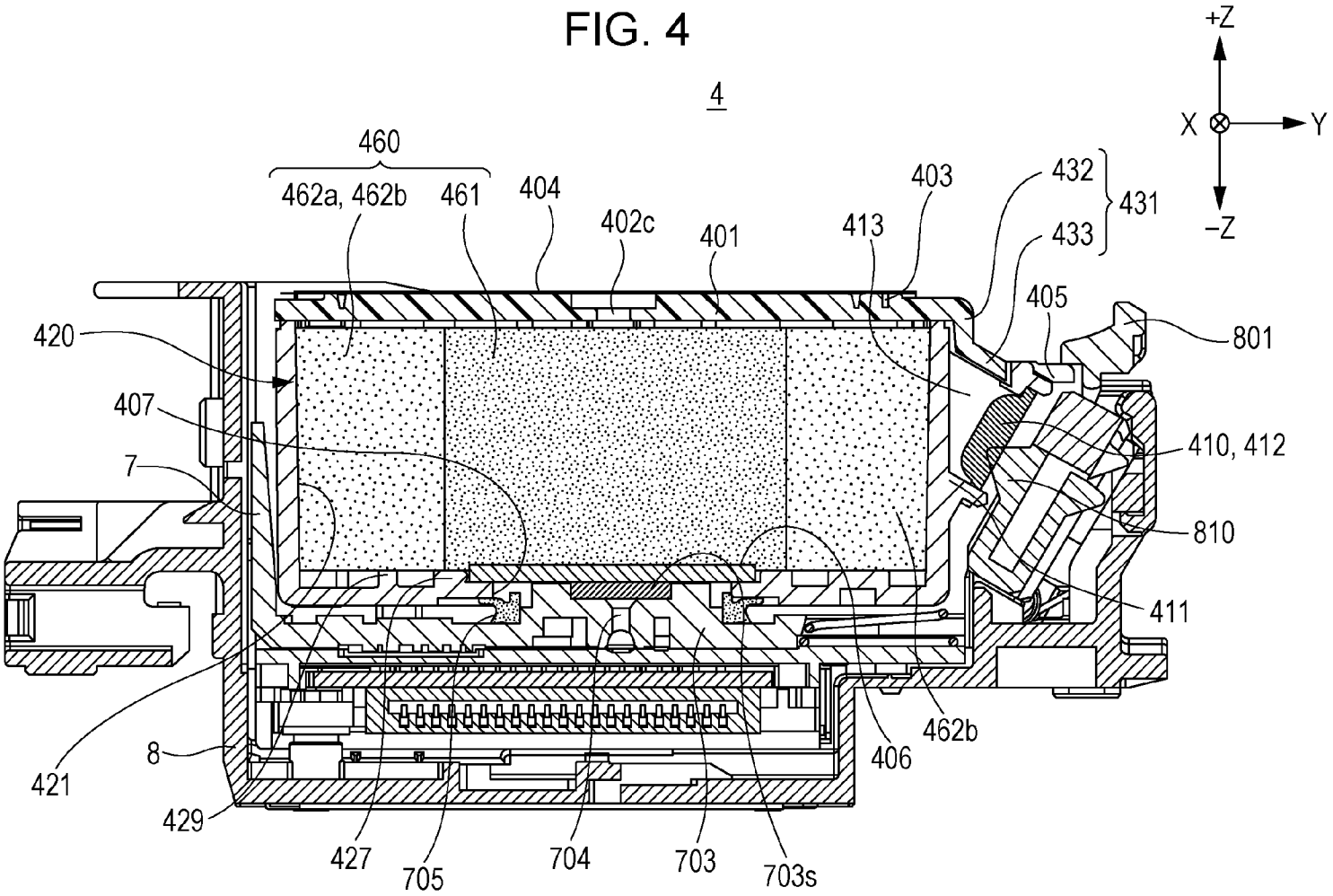
FIG. 4 is a cross-sectional view showing the configuration of a cartridge (liquid accommodating container).

FIG. 3 is an external view showing the configuration of a cartridge. More specifically, FIG. 3 is an external view showing a state in which the cartridges 4 and 5 are mounted to the carriage 8. FIG. 4 is a schematic cross-sectional view taken along line IV-IV in FIG. 3. The cartridge mounting portion 7 is not shown in FIG. 3 due to being mounted to the bottom portion of the carriage 8.

As shown in FIG. 3, both of the cartridges 4 and 5 include through holes 402*a*, 402*b*, 502*a*, and 502*b* that pass through a lid, air grooves 403 and 503 that extend meandering between the through holes 402*a* and 402*b* and through holes 502*a* and 502*b*, and fill holes 402*c* and 502*c* in the lids 401 and 501, respectively. The fill hole 402*c* is used in the initial filling of ink in the cartridge 4. Since the three colors of ink of yellow, magenta, and cyan are accommodated as described previously, the cartridge 5 is provided with through holes 502*a* and 502*b* for each color and includes air grooves 503 that extend wandering between the through holes 502*a* and 502*b* for each color. The fill holes 502*c* for each color are also used in the initial filling of ink. In both of the cartridges 4 and 5, seal members 404 and 504 are bonded to the upper surfaces of the lids 401 and 501 and cover the openings of the through holes, the fill holes and the air grooves.

The cartridge 4 bonded with the seal member is mounted to the carriage 8 via the cartridge mounting portion incorporated to the bottom portion of the carriage 8 as shown in FIG. 4, and are arranged lined up in the transport direction (X axis direction) of the carriage 8 in the mounted state. In the mounted state, the bonding portion 405 as a removing mechanism portion included in the cartridge 4 engages the cartridge engagement arm 801 of the carriage 8. The cartridge engagement arm 801 is arranged for each of the cartridge 4 and the cartridge 5. The user, by applying an external force on the cartridge engagement arm 801, rotationally displaces each engagement arm, thereby releasing the engagement with the engagement portion 405 for each cartridge. By the engagement of the carriage 8 and the cartridge 4 being released, a user is able to remove the cartridge 4 from the carriage 8. Removing and remounting such a cartridge is performed when the carriage 8 is stopped at the second stop position Pr shown in FIG. 2. In other words, when the carriage 8 is stopped at the second stop position Pr by the controller 60, the opening operation of the recording portion protective cover 18 shown in FIG. 1 is permitted, and the removal and remounting of the cartridge by the user is possible after the cover opening operation. The engagement configuration of the cartridge 5 and the carriage 8 includes a similar configuration to the cartridge 4, and the cartridge 5 is configured to be removable from the carriage 8.

The carriage 8 includes the cartridge mounting portion 7, and a liquid introduction portion for black ink, a liquid introduction portion for yellow ink, a liquid introduction portion for magenta ink, and a liquid introduction portion for cyan ink are included in the cartridge mounting portion 7.

The liquid introduction portion for each ink above is arranged corresponding to the liquid accommodation portion of the cartridges 4 and 5 mounted to the cartridge mounting portion 7, and each has the same configuration although the sizes thereof are different from one another. When an example of the liquid introduction portion corresponding to the cartridge 4 is described, the liquid introduction portion includes a liquid introduction base portion 703, a metal mesh 703*s*, and an elastic member 705. The metal mesh 703*s* is a porous body formed from a metal provided with corrosion resistance, such as a stainless steel, is incorporated in the upper end of the liquid introduction base portion 703, and make surface contact with liquid holding member 406 on the supply hole side of the cartridge 4 (refer to FIG. 4). The ink held in the supply hole side liquid holding member 406 passes through the metal mesh 703*s*, and is delivered to the discharging head 8*s* included in the bottom surface of the carriage 8.

The cartridge 4 includes a circuit substrate 410 on one end side in the +Y axis direction as shown in FIG. 4, and fixes and holds the circuit substrate 410 to the inclined substrate mounting portion 411. The circuit substrate 410 included on the cartridge 4 includes a terminal 412. In a state where the cartridge 4 is mounted to the carriage 8, the contact portion of the terminal 412 is electrically in contact with the electrode of the electrode aggregation 810 in the carriage 8. The cartridge 4 includes an end portion of the substrate mounting portion 411 in the X-axis direction in the drawing as an engagement portion 405, and the engagement portion 405 engages the cartridge engagement arm 801 on the carriage 8 in a state where the cartridge 4 is mounted to the carriage 8.

As shown in FIG. 4, the cartridge 4 includes a supply hole side liquid holding member 406 having a function of absorbing and holding a liquid, and a liquid holding member 460. The supply hole side liquid holding member 406 and the liquid holding member 460 are in contact with each other. The cartridge mounting portion 7 brings the metal mesh 703*s* attached to the annular tip of the liquid introduction base portion 703 of the liquid introduction portion provided on the bottom surface thereof into surface contact with the supply hole side liquid holding member 406. The supply hole side liquid holding member 406 is raised further upward than the liquid introduction base portion 703 and presses the liquid holding member 460. In so doing, the liquid accommodated in the liquid holding member 460, that is, black ink is supplied to the discharging head 8*s* of the carriage 8 through the supply hole side liquid holding member 406, the metal mesh 703*s* of the liquid introduction base portion 703 in the liquid introduction portion, and the suction hole 704. In other words, the liquid introduction portion of the carriage 8 receives the introduction of the liquid (black ink) from the cartridge 4, and the carriage 8 ejects the liquid (black ink) introduced to the liquid introduction portion from the discharging head 8*s*. The cartridge 5 also includes a circuit substrate similarly to the cartridge 4, and is mounted to the carriage 8 as described above.

The cartridge 4 includes an ink supply hole 407 covered by the supply hole side liquid holding member 406. The elastic member 705 included in liquid introduction portion of the carriage 8 abuts on the peripheral edge depression portion on the periphery of the ink supply hole 407, and is sealed so as to prevent ink leakage from the ink supply hole 407.

Figure 5:
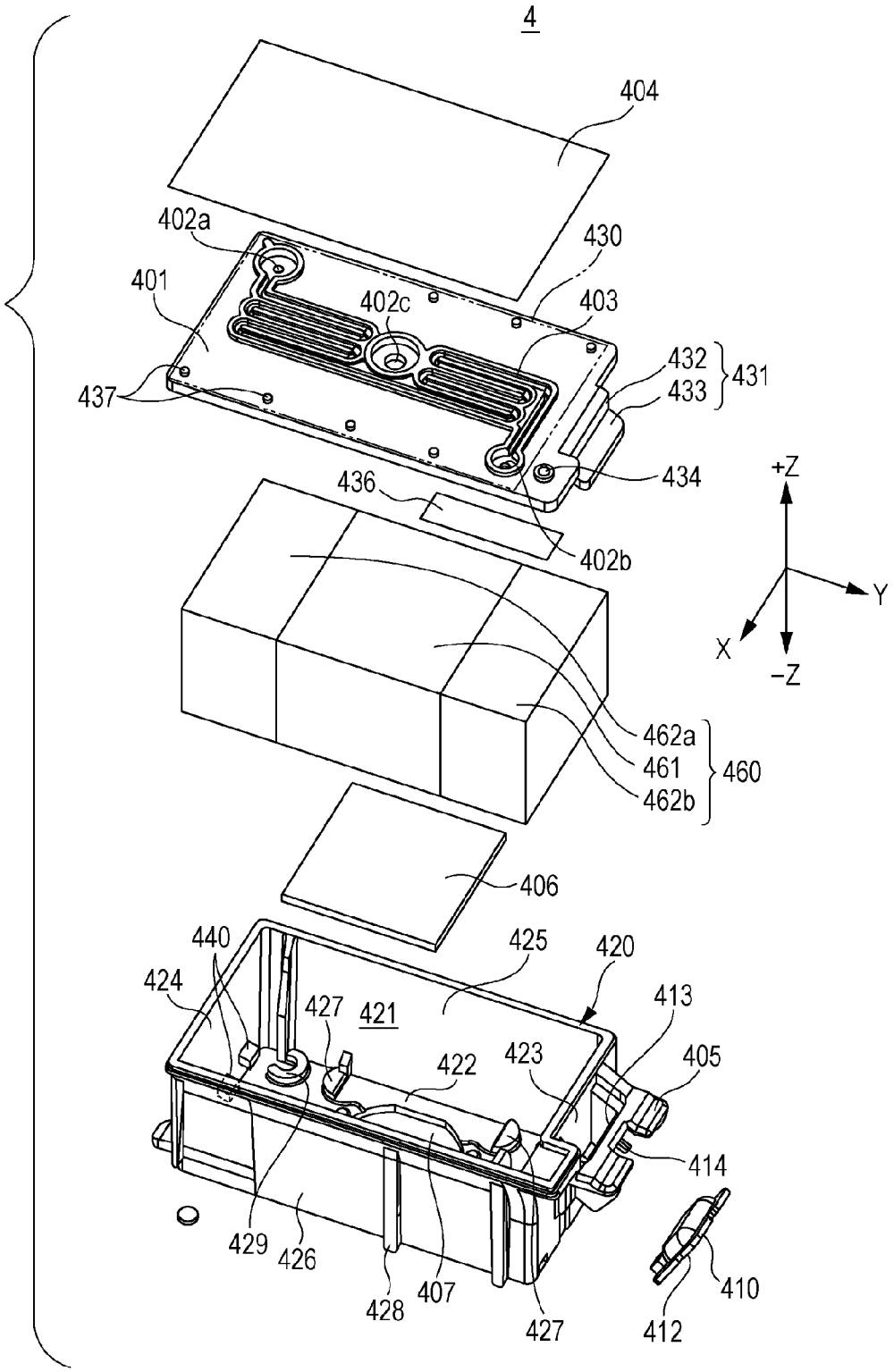
FIG. 5 is an exploded view showing the configuration of a cartridge (liquid accommodating container).

Next, the detailed configuration of the cartridge 4 will be described. FIG. 5 is an exploded view showing the configuration of a cartridge 4. As shown in the drawings, the cartridge 4 includes a housing 420, a lid 401, and a circuit substrate 410. The lid 401 is fixed to the housing 420, and covers a concavity 421 (refer to FIG. 4) included in the housing 420. In addition, the cartridge 4 includes a supply hole side liquid holding member 406, a liquid holding member 460, a lid rear surface seal member 436, and a seal member 404. The housing 420 and the lid 401 are molded articles of a synthetic resin such as polyethylene or polypropylene, and is formed with an appropriate molding method, such as injection molding.

The housing 420 includes a bottom wall 422, a first end wall 423, a second end wall 424, a first side wall 425, and a second side wall 426. In the first side wall 425 and the second side wall 426, the outer wall is reinforced with a rib 428. The bottom wall 422 forms the bottom surface of the housing 420, and includes an ink supply hole 407 in the center thereof. The bottom wall 422 faces the lid 401. The first end wall 423 rises upward from the bottom wall 422 and intersects the lid portion 430 of the lid 401. The second end wall 424 rises upward from the bottom wall 422 and intersects the lid portion 430 of the lid 401, and along therewith, faces the first end wall 423. The first side wall 425 rises upward from the bottom wall 422 between one end portion (−X direction end portion in FIG. 5) of the first end wall 423 and one end portion (−X direction end portion in FIG. 5) of the second end wall 424, and intersects the lid portion 430 of the lid 401. The second side wall 426 rises upward from the bottom wall 422 between the other end portion (+X direction end portion in FIG. 5) of the first end wall 423 and the other end portion (+X direction end portion in FIG. 5) of the second end wall 424, intersects the lid portion 430 of the lid 401, and faces the first side wall 425.

Such a wall surface configuration is able to be represented as follows. The housing 420 includes a bottom wall 422 that faces the lid 401, a first end wall 423 that intersects the lid 401 and the bottom wall 422, a second end wall 424 that intersects the lid 401 and the bottom wall 422 and faces the first end wall 423, a first side wall 425 that intersects the lid 401, the bottom wall 422, the first end wall 423, and the second end wall 424, and a second side wall 426 that intersects the lid 401, the bottom wall 422, a first end wall 423, and the second end wall 424, and faces the first side wall 425.

The circuit substrate 410 includes a plurality of terminals 412 on the substrate surface and is positioned on the first end wall 423 of the housing 420. A substrate mounting portion 411 is formed on the first end wall 423 (refer to FIG. 4). The substrate mounting portion 411 inclines with respect to the first end wall 423. The circuit substrate 410 is fixed by the rear surface thereof to the substrate mounting portion 411 and inclines with respect to the first end wall 423. In the circuit substrate 410, the terminal 412 is electrically connected to each electrode of the electrode aggregation 810 on the carriage 8 side, as shown in FIG. 4, when the cartridge 4 is mounted to the carriage 8, as described above.

The substrate mounting portion 411 includes an opening 413 (refer to FIG. 4) on the outer wall surface side of the first end wall 423. The opening 413 extends in the Z axis direction from the upper end side to the lower end side of the first end wall 423 along the outer wall surface of the first end wall 423, and is opened in the upper and lower end sides of the first end wall 423. On the other hand, when the lid 401 is fixed to the housing 420, the opening 413 is closed and blocked on the upper end side of the first end wall 423 by the outward extension portion 431 included in the lid 401. A convexity 414 protruding from the substrate mounting portion 411 is used in fixing the circuit substrate 410 to the substrate mounting portion 411. The convexity 414 is subjected to heat caulking in a state where the convexity 414 is extended from the circuit substrate 410. In so doing, the circuit substrate 410 is fixed to the substrate mounting portion 411.

The lid 401 includes a lid portion 430 and an outward extension portion 431. The lid portion 430 has a flat plate shape, and covers the concavity 421 of the housing 420. The outward extension portion 431 is a part extending outward from the lid portion 430 on the side of the first end wall 423 on which the circuit substrate 410 having the terminal 412 is positioned, and includes a bent extension portion 432 and an inclined extension portion 433. A bent extension portion 432 extends so as to protrude by being bent approximately 90 degrees from the lid portion 430 along a first direction (−Z direction in FIG. 5) from the lid 401 towards the housing 420. The inclined extension portion 433 that is continuous with the bent extension portion 432 extends to a position that overlaps on the terminal 412 of the circuit substrate 410 in plan view of the lid 401 from the first direction (−Z direction in FIG. 5) from the lid 401 towards the housing 420. The outward extension portion 431 overlaps the opening 413 and closes and blocks the opening 413 at the upper end side of the first end wall 423, when the lid 401 is fixed to the housing 420. The outward extension portion 431 engages the inclined extension portion 433 to the opening 413 of the substrate mounting portion 411 when the lid 401 is fixed to the housing 420. In addition, the outward extension portion 431 protrudes further outward than the terminal 412 of at least the lower level side of the circuit substrate 410 in a second direction (+Y direction in FIGS. 4 and 5) in which the inclined extension portion 433 extends from the second end wall 424 to the first end wall 423. The inclined extension portion 433 is extended longer from the state shown in the drawings, and may be protruded further to outward than all of the terminals 412 of the circuit substrate 410.

The lid 401 includes an atmosphere communication hole 434 and a plurality of seal member receiving seats 437, in addition to the above-described through holes 402*a* and 402*b*, the filling hole 402*c* and the air groove 403. The seal member receiving seat 437 protrudes from the upper surface of the lid 401 with the same height as the peripheral walls of the through holes 402*a* and 402*b*, and the peripheral wall of the air groove 403, and is a bonding receiving seat of the seal member 404.

The atmosphere communication hole 434 is formed in the lid portion outer edge in which a portion of the lid portion 430 extends in the Y axis direction, and passes through the lid 401 in the lid portion outer edge. The atmosphere communication hole 434 is connected to the communication hole 402*b* on the rear surface side of the lid 401 by an air groove, not shown.

The air groove and lid rear surface side opening of the atmosphere communication hole 434 and the lid rear surface side opening of the through hole 402*b* are sealed with the lid rear surface seal member 436. In so doing, it is possible to open the concavity 421 of the housing 420 blocked by the lid 401 to the atmosphere with the atmosphere communication hole 434 via the through hole 402*a*, the air groove 403, and the through hole 402*b*. This opening to the atmosphere will be described in association with the liquid holding member 460.

The liquid holding member 460 is formed as one article in which the first holding member 461 is pinched by the second holding members 462*a* and 462*b* on the left and right thereof, and is accommodated in the concavity 421 of the housing 420 along with the supply hole side liquid holding member 406. The bottom wall 422 of the housing 420 includes a semicircular projection 427 with a stepped shape on the periphery of the ink supply hole 407, and the supply hole side liquid holding member 406 is place on the stepped portion of the semicircular projection 427 (refer to FIGS. 4 and 5). In so doing, the ink supply hole 407 is covered with the supply hole side liquid holding member 406. The bottom wall 422 includes an arced projection 429 with an open arc shape in plan view on the periphery of each corner site. The liquid holding member 460 is accommodated in the housing 420 so as to be supported by the upper surface of the arced projection 429 in each corner and the semicircular projection 427. When the liquid holding member 460 is accommodated in this way, the lid 401 in which the lid rear surface seal member 436 and the seal member 404 are bonded is melted and fixed to the housing 420, and the cartridge 4 shown in FIG. 4 or the like is obtained.

The first holding member 461 of the supply hole side liquid holding member 406 and the liquid holding member 460 and the second holding members 462*a* and 462*b* on the left and right thereof are configured from a fiber member (detailed configuration described late) in which the fiber form is bundled. The supply hole side liquid holding member 406 and the liquid holding member 460 have different characteristics for holding the liquid. The supply hole side liquid holding member 406 has a greater pore density indicating the formation density of the pores than any of the holding members of the first holding member 461 of the liquid holding member 460 and the second holding members 462*a* and 462*b* on the left and right thereof. The first holding member 461 has a greater pore density than the second holding members 462*a* and 462*b* on the left and right. The second holding member 462*a* and 462*b* on the left and right of the first holding member 461 has approximately the same pore density.

Due to the magnitude relationship of the pore density above, the supply hole side liquid holding member 406 and the first holding member 461 of the liquid holding member 460 and the second holding members 462*a* and 462*b* on the left and right thereof have the magnitude relationship described as follows for the capillary action. That is, the capillary action of the supply hole side liquid holding member 406 is greater than the capillary action of the first holding member 461. The capillary action of the first holding member 461 has a greater capillary action as the second holding members 462*a* and 462*b* on the left and right thereof. The capillary actions of the second holding members 462*a* and 462*b* are substantially the same.

By the supply hole side liquid holding member 406 and the first holding member 461 of the liquid holding member 460 and the second holding members 462*a* and 462*b* on the left and right thereof having the above magnitude relationship for the capillary action, the ink accommodated in the liquid holding member 460 flows in the order described below. That is, ink flow from the member with a small capillary action to the member with a large capillary action. As shown in FIG. 4, when the ink accommodated in the supply hole side liquid holding member 406 is suctioned through the liquid introduction portion and consumed, the ink accommodated in the first holding member 461 overlapping the upper surface of the supply hole side liquid holding member 406 moves to the supply hole side liquid holding member 406. The driving force of such ink movement is mainly the capillary action of the supply hole side liquid holding member 406. By atmosphere communication from the through hole 402*a* and the air groove 403 connected thereto and the atmosphere communication hole 434, a breakdown in ink movement does not occur.

By ink accommodated in the first holding member 461 moving to the supply hole side liquid holding member 406, when the ink of the first holding member 461 is consumed, the ink accommodated in the second holding members 462*a* and 462*b* on the left and right thereof moves to the first holding member 461. The driving force of such ink movement is mainly the capillary action of the first holding member 461. By atmosphere communication from the through hole 402*a* and the air groove 403 connected thereto and the atmosphere communication hole 434, a breakdown in ink movement does not occur.

In this way, it is possible to effectively consume ink accommodated in the liquid holding member 460 by the liquid holding member with the greater capillary action being arranged in order of proximity to the liquid introduction base portion 703 along with the supply hole side liquid holding member 406 and the first holding member 461 of the liquid holding member 460 and the second holding members 462*a* and 462*b* on the left and right thereof with different characteristics to the concavity 421 of the housing 420 being accommodated. That is, it is possible for the remainder of unused ink in the liquid holding member 460 to be reduced. The cartridge 4 causes ink to move from the liquid holding member 460, specifically the first holding member 461 to the liquid introduction portion of the carriage 8 via the supply hole side liquid holding member 406 according to the above-described storage between the supply hole side liquid holding member 406 and the liquid holding member 460 to the concavity 421, thereby introducing ink to the liquid introduction portion.

As long as the configuration is one in which the capillary action of the supply hole side liquid holding member 406 and the first holding member 461 of the liquid holding member 460 and the second holding members 462*a* and 462*b* on the left and right thereof decreases according to the separation from the liquid introduction base portion 703, the magnitude relationship of the pore density of each of the above liquid holding members is not limited to the embodiment. For example, even in a case where the pore densities of the supply hole side liquid holding member 406 and the first holding member 461 of the liquid holding member 460 and the second holding members 462*a* and 462*b* on the left and right thereof are the same, the configuration may have the magnitude relationship of the capillary action by subjecting each liquid holding member to a water repellency treatment and immersion treatment.

It is possible to regulate the magnitude relationship of the pore density of the supply hole side liquid holding member 406 and the first holding member 461 of the liquid holding member 460 and the second holding members 462*a* and 462*b* on the left and right thereof as follows. In a case where the pore of each of the liquid holding members is seen in cross-section in the XY plane orthogonal to the −Z axis direction (refer to FIG. 5) from the lid 401 toward the bottom wall 422, the pore density of each of the liquid holding members is able to be regulated by the magnitude of the average diameter corresponding to the XY plane cross-sectional view of each of the pores. If the pore density is large, the pore average diameter corresponding to the XY plane cross-sectional view is small. Thus, since the supply hole side liquid holding member 406 has a greater pore density compared to the first holding member 461, the pore average diameter corresponding to the XY plane cross-sectional view is smaller than the first holding member 461. Similarly, since the first holding member 461 has a greater pore density compared to the second holding members 462*a* and 462*b* on the left and right thereof, the pore average diameter corresponding to the XY plane cross-sectional view is smaller than the second holding members 462*a* and 462*b*.

Next, the configuration of the liquid holding member 460 accommodated in the cartridge 4 and 5 will be described. The liquid holding member 460 according to the embodiment is configured from a fiber member in which fibers are bundled. The fibers that configure the fiber member have a double structure of a core and sheath, and are obtained by a melt and blow method. The sheath component of the double structure is formed by a propylene polymer. Polypropylene is generally used as the propylene polymer. Other than the polypropylene, it is possible for several wt % of ethylene or another monomer to be copolymerized with propylene and used.

A thermoplastic polymer having a lower melting point than the melting point of the propylene polymer that is the sheath component is used as the core component of the double structure fiber. Although the difference in melting points is a matter able to be arbitrarily decided, as desired, approximately 5° C. to 60° C. is preferable.

A polyethylene is generally used as the thermoplastic polymer. That is, the linear low density polyethylene, medium density polyethylene, high density polyethylene and the like are used. Other than the polyethylene, it is possible to use an ethylene-propylene copolymer in which ethylene and propylene are copolymerized, a butene-1-propylene copolymer in which butene-1 and propylene are copolymerized, an ethylene-polyvinyl acetate copolymer in which ethylene and polyvinyl acetate are copolymerized, a copolymer polyester, a copolymer polyamide, and the like. It is also further possible to use a mixture of a propylene polymer represented by polypropylene and an ethylene polymer represented by polyethylene as the thermoplastic polymer.

In the double structure fibers used in the invention, a composite ratio of the sheath component and the core component being sheath component:core component=20-80:80-20 (mass ratio) is preferable. When the sheath component is reduced exceeding this range, it tends to be difficult to completely surround and coat the core component. Conversely, when the core component is reduced exceeding this range, the flexibility and high durability or the core portion with respect to the fibers tends to be lowered.

It is preferable that the cross-sectional diameter of the fibers of the fiber member used in the invention is 10 μm or more to 50 μm or less, and 20 μm or more to 40 μm or less is more preferable. When the cross-sectional diameter of the fiber exceeds 50 μm, the diameter of the fiber thickens, the flexibility of the fiber itself is lowered, and the flexibility and the storage capacity with respect to the cartridges 4 and 5 are lowered. When the cross-sectional diameter of the fiber is less than 20 μm, the absorption and the maintenance efficiency of the liquid composition tends to be lowered.

It is preferable that the fiber rate of the double structure fiber used in the invention is 5% or more to 30% or less and 10% or more to 25% or less is more preferable. Here, the fiber ratio is the proportion of fibers occupied in a unit volume of a fiber molded body. Using the porosity, it is also possible to represent fiber ratio=(100%−porosity). If this range is used, the supply efficiency of the liquid is good.

The characteristics and the like of the invention were measured by the following method.

1. Average Fiber Diameter of Fiber Member (μm)

One hundred fibers of the fiber member that configures the liquid accommodating body were measured at a magnification of 1000 times using a digital microscope (VHX-500, manufactured by Keyence Corporation). The measurement device was calibrated using a VHX reference scale OP-51483 after adjustment to the observation magnification and measurement was performed using the measurement function of the measurement device. The average value in which the cross-sectional diameter of the fibers was measured was made the fiber diameter of the fibers.

2. Basis Weight (g/m$^2$)

Ten samples measuring 15 mm in the vertical direction×15 mm in the horizontal direction were created, the weight of each sample was measured, the average value of the obtained values was converted to a per unit area value, and rounded to the first decimal place.

3. Porosity (%)

The numerical value obtained with the following calculation formula using the results in which the thickness for an arbitrary location in the fiber member created with the "2. basis weight" was measured for 10 seconds at 0.7 kPa, in compliance with JIS 1096, using a thickness measurement device, the basis weight, and the density of the fibrous raw material used in the fiber member was rounded to the first decimal place, thereby obtaining the porosity.

$$\text{Porosity}(\%)=(1-(\text{basis weight}/\text{thickness}/\text{density of fibrous raw material}))\times 100$$

The method of manufacturing the fiber molded body of the invention includes evenly arranging a plurality of slit pieces in which a non woven fabric of the double structure fibers is cut in a long shape to one another along the longitudinal direction, and heat molding the arranged aggregate, thus forming a plate-like fiber molded body. It is possible to obtain a fiber molded body suitable to the cartridges 4 and 5 by overlapping, heating and crimping a plurality of plate-like fiber molded bodies.

Next, the composition of ink as the liquid accommodated in the cartridge 4 and 5 will be described.

First, the composition of the black ink will be described. The pigment of the black ink composition able to be used in the invention is a self-dispersing pigment.

Self-dispersing pigments are pigments capable of either or both of dispersing and dissolving in an aqueous medium without a dispersing agent. Here, "either or both of dispersing and dissolving in an aqueous medium without a dispersing agent" indicates a state of stably existing in the aqueous medium due to a hydrophilic group of the surface thereof even without using a dispersing agent for dispersing the pigments.

Because the pigment is normally dispersed in the ink containing a self-dispersing pigment as the coloring agent, it is unnecessary for a dispersant as described above to be contained. Therefore, there is almost no foaming due to lowering of the defoaming caused by the dispersant, an ink with excellent discharge stability is easily prepared. Because great increases in the viscosity caused by the dispersant are suppressed, it is possible for more pigment to be contained, and the printing density to be sufficiently increased, and handling becomes easy.

The black ink composition of the invention is a self dispersing pigment having a hydrophilic group on the pigment surface, and it is preferable that the hydrophilic group is one or more hydrophilic group selected from a group composed of —OM, —COOM, —CO—, —$SO_3M$, —$SO_2M$, —$SO_2NH_2$, —$RSO_2M$, —$PO_3HM$, —$PO_3M_2$, —$SO_2NHCOR$, —$NH_3$, and —$NR_3$ (in the formula, M represents a hydrogen atom, an alkali metal, ammonium, or an organic ammonium, and R represents an alkyl group having 1 to 12 carbon atoms, or a naphthyl group that may have a substituent).

It is possible to use a carbon black manufactured by a known method, such as a contact method, a furnace method, or a thermal method as the pigment that is the raw material of the self dispersing pigment of the black ink composition. In the invention, preferable examples of the carbon black include No. 2300, 900, MCF88, No. 20B, No. 33, No. 40, No. 45, No. 52, MA7, MA8, MA100, and No2200B (all manufactured by Mitsubishi Chemical Co., Ltd.), color black FW1, FW2, FW2V, FW18, FW200, 5150, 5160, 5170, Printex 35, U, V, 140U, special black 6, 5, 4A, 4, and 250 (all manufactured by Degussa AG), Conductex SC, Loewen 1255, 5750, 5250, 5000, 3500, 1255, and 700 (all manufactured by Columbia Carbon, Ltd.), and Regal 400R, 330R, 660R, Mogul L, Monarch 700, 800, 880, 900, 1000, 1100, 1300, 1400, and Elf Tex 12 (manufactured by Cabot, Co.). These carbon blacks may be used singly or two or more types may be used as a mixture.

The self dispersing pigment of the black ink composition is manufactured by the hydrophilic group being bonded (grafted) to the surface of the pigment by subjecting the pigment to a physical treatment or a chemical treatment. Examples of the physical process include vacuum plasma processing and the like. Examples of the chemical treatment include a wet oxidation method of oxidizing with an oxidant in water, and the like.

In the invention, it is preferable from the viewpoint of high color development that the black self-dispersing pigments undergo surface processing by oxidation treatment using either or both of hypohalous acid and a hypohalous acid salt, an oxidation process using ozone, or an oxidation process using either or both of persulfuric acid and a persulfuric acid salt. It is possible to use a commercially available product as the self dispersing pigment of the black ink composition, and preferable examples include Microjet CW1 (manufactured by Orient Chemical Industries Co., Ltd.).

It is preferable that 3 wt % or more of the self dispersing pigment is contained in the black ink composition. In cases where the pigment concentration in the black ink composition is 3 wt % or more, the color development of the recording material is high.

For the self dispersing pigment, from the viewpoint of reducing the precipitation of the pigment, the volume average particle diameter (D50) of the pigment particle diameter distribution measured with a dynamic light scattering method satisfies a condition of 50 nm<D50<150 nm, and the volumetric maximum particle size of the pigment particle diameter distribution is 200 nm or less. The particle size of the pigment is comparatively small, and variations in the particle size are reduced and precipitation of the pigment is lowered. It is still more preferable that the particle size of the pigment satisfies a condition of 60 nm<D50<80 nm. It is possible to further suppress precipitation of the pigment.

Here, D50 refers to the median diameter. The median diameter is the diameter at which the product frequency on the large and small sides becomes equivalent when the particle size is divided by two in a distribution (product frequency) for each particle size in a powder. Specifically, the median diameter is obtained from the product distribution in a case where the particle size is measured volumetrically by a Microtrac (laser diffraction method), and, for example, and may be measured with a UPA-EX by Nikkiso Co., Ltd.

It is preferable that the black ink composition of the invention includes at least 80 mass % to 10 mass % of water, a water-soluble organic solvent, and a surfactant.

By regulating the content of the water included in the ink composition to the above range, it is possible for the swelling of cellulose though to be a cause of cockling and curling to be suppressed as a result of the water content absorbed in the cellulose in a coating paper is less than the ink composition of the related art. Accordingly, the ink composition of the embodiment is also useful with respect to a recording medium having an absorbent layer of a paper support with poor ink absorbency, such as ordinary paper or a coated paper for printing (book printing paper).

Water is the main solvent contained in the black ink composition of the invention, and it is preferable to use pure waters, such as ion-exchange water, ultrafiltered water, reverse osmosis water, and distilled water or ultrapure water. In particular, using water subjected to a sterilization treatment by ultraviolet irradiation, addition of hydrogen peroxide or the like is preferable on the point of enabling long term storage of the ink composition by preventing the occurrence of mildew or bacteria.

In the invention, examples of the water soluble organic compound include polyvalent alcohols such as glycerin, 1,2,6-hexane triol, trimethylol propane, ethylene glycol, propylene glycol, diethylene glycol, triethylene glycol, tetraethylene glycol, pentaethylene glycol, dipropylene glycol, 2-butene-1,4-diol, 2-ethyl-1,3-hexane diol, 2-methyl-2,4-pentanediol, 1,2-octane diol, 1,2-hexane diol, 1,2-pentanediol, and 4-methyl-1,2-pentanediol, sugars such as glucose, mannose, fructose, ribose, xylose, arabinose, galactose, aldonic acid, glucitol, (sorbitol), maltose, cellobiose, lactose, sucrose, trehalose, and maltotriose, sugar alcohols, hyaluronic acids, so-called solid wetting agent such as ureas, alkyl alcohols with 1 to 4 carbon atoms such as ethanol, methanol, butanol, propanol, and isopropanol, glycol ethers such as ethylene glycol monomethyl ether, ethylene glycol mono ethyl ether, ethylene glycol monobutyl ether, ethylene glycol monomethyl ether acetate, diethylene glycol monomethyl ether, diethylene glycol mono ethyl ether, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol mono ethyl ether, propylene glycol mono-t-butyl ether, propylene glycol mono-n-propyl ether, propylene glycol mono-iso-propyl ether, dipropylene glycol monomethyl ether, dipropylene glycol monoethyl ether, dipropylene glycol monomethyl-n-propyl ether, and dipropylene glycol mono-iso-propyl ether, 2-pyrrolidone, N-methyl-2-pyrrolidone, 1,3-dimethyl-2-imidazolidinone, formamide, acetamide, dimethyl sulfoxide, sorbitol, sorbitan, acetin, diacetin, triacetin, and sulfolane. It is possible to use these singly or two or to use two or more types, and it is preferable to include 10 wt % to 90 wt % of these water soluble organic solvents in the black ink composition from the viewpoints of securing suitable property values (such as viscosity) of the black ink composition, and securing printing quality and reliability. By including the water soluble organic solvents in the black ink composition of the invention, the storage stability and the discharge stability are excellent, even with a high solid content.

In the invention, it is possible to provide a black ink composition with excellent reliability, such as printing quality, discharge stability, and clogging recovery by using at least polyvalent alcohols, butyl ethyls of glycol and pyrrolidones together as the water-soluble organic solvent. It is known that the polyvalent alcohols are suitable to controlling the water retention (moisture retention) and the permeability of the black ink composition to a recording medium such as an ordinary paper, the butyl ethers of glycol are suitable to controlling the discharge stability and the permeability of the ink composition to a recording medium, and the pyrrolidones greatly contribute to discharge stability, and the storage stability and color development of the ink composition, and it is further possible to provide a black ink composition with high reliability, such as printing quality, discharge stability, and clogging recovery by using the polyvalent alcohols, the butyl ethers of glycol, and the pyrrolidones together.

In the embodiment, 5 wt % or more of either or both of a polyvalent alcohol mono alkyl ether and a nitrogen containing cyclic compound is included as the water soluble organic solvent, and it is preferable to include a polyvalent alcohol. By using the water soluble organic solvent, it is possible to suppress cockling and curling and possible to ensure print quality with reduced bleeding, unevenness and the like.

Here, examples of the polyvalent alcohol monoalkyl ether include diethylene glycol mono ethyl ether, diethylene glycol monobutyl ether, diethylene glycol mono isobutyl ether, dipropylene glycol monomethyl ether, dipropylene glycol mono-isopropyl ether, dipropylene glycol mono-isopropyl ether, dipropylene glycol monobutyl ether, triethylene glycol monomethyl ether, triethylene glycol monobutyl ether, tripropylene glycol monomethyl ether, tripropylene glycol monobutyl ether from among glycol ethers, and examples of the nitrogen-containing cyclic compounds include 1,3-dimethyl-2-imidazolidinone, 2-pyrrolidone, N-methyl-2-pyrrolidone, and ϵ-caprolactam.

Here, although it is possible to use any polyvalent alcohol, it is particularly preferable that the polyvalent alcohol includes a 1,2-alkanediol such as 1,2-pentanediol, 1,2-hexanediol, and 1,2 octanediol.

It is possible to contain an anionic surfactant, a cationic surfactant, an amphoteric surfactants and a nonionic surfactant as the surfactant contained in the black ink composition of the invention. A nonionic surfactant is particularly preferable from the viewpoint of obtaining an ink composition with little foaming and bubbling.

More specific examples of the nonionic surfactants include acetylene glycol-based surfactants, acetylene alcohol-based surfactants, ethers such as polyoxyethylene nonyl phenyl ether, polyoxyethylene octyl phenyl ether, polyoxyethylene dodecyl phenyl ether, polyoxyethylene alkyl allyl ether, polyoxyethylene oleyl ether, polyoxyethylene lauryl ether, polyoxyethylene alkyl ether, and polyoxyalkylene alkyl ether; esters such as polyoxyethylene oleic acid, polyoxyethylene oleic acid ester, polyoxyethylene distearate, sorbitan monolaurate, sorbitan monostearate, sorbitan monooleate, sorbitan sesquioleate, polyoxyethylene monooleate, polyoxyethylene stearate, polyether modified siloxane-based surfactants such as dimethyl polysiloxane, and fluorine-containing surfactants such as other fluorine esters, and perfluoroalkyl carboxylate. These nonionic surfactants are preferably used independently or two or more types are preferably used in combination.

Among the nonionic surfactants, either or both of an acetylene glycol-based surfactant and a polyether modified siloxane-based surfactant is preferable on the point of having little foaming and excellent anti-foaming capacity.

Although specific examples of the acetylene glycol-based surfactant include 2,4,7,9-tetramethyl-5-decyne-4,7-diol, 3,6-dimethyl-4-octyne-3,6-diol, and 3,5-dimethyl-1-hexyne-3-ol, it is also possible to use commercially available products and examples thereof include Surfynol 104, 82, 465, 485, and TG by Air Products and Chemicals Inc. and Olfine STG, and Olfine E1010 manufactured by Nissin Chemical Industry Co., Ltd. Further specific examples of the polyether modified siloxane-based surfactant include BYK-345, BYK-346, BYK-347, BYK-348, and UV 3530 by BYK Chemie Japan Co., Ltd. A plurality of types thereof may be used in the ink composition, and it is preferable to adjust the surface tension to 20 mN/m to 40 mN/m, and 0.1 wt % to 3.0 wt % is included in the ink composition.

It is preferable for the black ink composition of the invention to contain a pH adjuster. Examples of the pH adjuster include either or both of alkali hydroxides such as lithium hydroxide, potassium hydroxide, and sodium hydroxide and alkanolamines such as ammonia, triethanol amine, tripropanol amine, diethanol amine, and monoethanol amine. In particular, it is preferable that at least one type of pH adjuster selected from a hydroxide of an alkali metal, ammonia, triethanol amine, and tripropanol amine is included, and the pH is adjusted to 6 to 10. When the pH departs from this range, the material or the like that configures the ink jet printer is adversely influenced, and the clogging recovery deteriorates.

It is possible to use, as necessary, collagen, imidazole, phosphoric acid, 3-(N-morpholino) propane sulphonate, tris (hydroxymethyl)amino methane, borate and the like as a pH buffer.

It is further possible to add, as necessary, an antifoaming agent, an antioxidant, an ultraviolet ray absorber, a preservative and fungicide and the like in the black ink composition.

Examples of the antioxidant and the ultraviolet absorber include allophanates such as allophanate and methyl allophanate, biurets such as biuret, dimethyl biuret, and tetramethyl biuret, L-ascorbic acid and salts thereof, and the like, Tinuvin 328, 900, 1130, 384, 292, 123, 144, 622, 770, and 292, Irgacor 252 and 153, and Irganox 1010, 1076, 1035, MD 1024 manufactured by Ciba-Geigy Pvt, Ltd., or compounds such as lanthanide.

Examples of the preservative and fungicide include, for example, sodium benzoate, sodium pentachlorophenolate, 2-pyridinethiol-1-sodium oxide, sodium sorbate, dehydro sodium acetate, and 1,2-benzisothiazolin-3-one (Proxel CRL, Proxel BDN, Proxel GXL, Proxel XL-2, Proxel TN by Avecia Inc.) and the like.

Next, the color ink composition will be described. A self dispersing pigment able to either or both of dispersed and dissolved in water without a dispersant, a resin-coated pigment coated with a dispersion resin, and a water-insoluble polymer resin-coated pigment are used as the pigment of the color ink composition able to be used in the invention, similarly to the pigment of the black ink composition.

In cases where the pigment included in the color ink composition of the invention is a self dispersing pigment having a hydrophilic group on the pigment surface intermediated by a phenyl group, and it is preferable that the hydrophilic group, similarly to the case of the black ink composition, is one or more hydrophilic group selected from a group composed of —OM, —COOM, —CO—, $—SO_3M$, $—SO_2M$, $—SO_2NH_2$, $—RSO_2M$, $—PO_3HM$, $—PO_3M_2$, $—SO_2NHCOR$, $—NH_3$, and $—NR_3$ (in the formula, M represents a hydrogen atom, an alkali metal, ammonium, or an organic ammonium, and R represents an alkyl group having 1 to 12 carbon atoms, or a naphthyl group that may have a substituent).

In a case where the pigment as a coloring agent included in the color ink composition of the invention is a resin-coated pigment coated by a dispersion resin, the dispersion pigment is at least either one of a graft copolymer in which a polymer chain A is grafted to a polymer chain B and a block copolymer in which one terminal of the polymer chain A and one terminal of the polymer chain B are bonded, the polymer chain A includes 20 mass % to 60 mass % of a constituent unit derived a first cycloalkyl group-containing (meth)acrylate, 10 mass % to 35 mass % of a constituent unit derived from (meth)acrylic acid, and 5 mass % to 70 mass % of a constituent unit derived from another (meth)acrylate, and has a number average molecular weight of 1,000 to 10,000, the polymer chain B includes at least either of a constituent unit derived from a second cycloalkyl group-containing (meth)acrylate and a constituent unit derived from a vinyl monomer having an aromatic ring or (meth)acrylate, the mass ratio of the polymer chain A and the polymer chain B is A:B=30-70:70-30, and the number average molecular weight of the graft copolymer and the block copolymer is 2,000 to 20,000.

The dispersion resin is at least either of a graft copolymer in which a polymer chain A is grafted to a polymer chain B and a block copolymer in which one terminal of the polymer chain A and one end of the polymer chain B are bonded. The graft copolymer has one or more polymer chain A bonded (branched) with respect to the polymer chain B that is the main chain. The number of bonds of the polymer chain a with respect to one polymer chain B is not limited. The polymer chain A includes 20 mass % to 60 mass % of a constituent unit derived from a first cycloalkyl group-containing (meth)acrylate, 10 mass % to 35 mass % of a constituent unit derived from (meth)acrylate and 5 mass % to 70 mass % derived from another (meth)acrylate. The carboxyl group included in the constituent unit derived from (meth)acrylic acid is ionized by being neutralized with an alkali. Therefore, the polymer chain A including the constituent unit derived from (meth)acrylic acid is a polymer chain with the characteristic of dissolving in water.

The polymer chain B includes at least either of a constituent unit derived from a second cycloalkyl group-containing (meth)acrylate and a constituent unit derived from a vinyl monomer having an aromatic ring and a constituent unit derived from another (meth)acrylate used as necessary. The polymer chain B is a polymer chain insoluble in water, is adsorbed and deposited on the pigment by hydrophobic interaction, and coats (encapsulates) the pigment. By using a pigment dispersant having the polymer chain A and polymer chain B having different characteristics, it is possible for the pigment to be dispersed in a favorable state. The first cycloalkyl group-containing (meth)acrylate that configures the polymer chain A and the second cycloalkyl group-containing (meth)acrylate that configures the polymer chain B may be the same or different. Below, when "cycloalkyl group-containing (meth)acrylate" is used alone, either "first cycloalkyl group-containing (meth) acrylate" or "second cycloalkyl group-containing (meth)acrylate" is referred to.

The polymer chain B forms particles, and is stabilized by dissolving in an aqueous medium in the ink with the polymer chain A. Therefore, since the viscosity of the pigment dispersant is lowered by forming particles having a high stability, the dispersion stability of the pigment and the discharge properties of the ink are not impeded. Since the amount of the carboxyl group in the polymer chain A is suitably controlled, the solubility in water of the pigment dispersant is high. Therefore, even in a case of being dried on the ink head, the pigment is easily redissolved or redispersed in another aqueous medium such as a cleaning solution.

Polymer Chain A

The polymer chain A includes a cycloalkyl group. By using the pigment dispersant including the polymer chain A having a cycloalkyl group, it is possible to prepare an aqueous pigment ink able to record a printed matter with high color development, high saturation and high gloss. Specific examples of the first cycloalkyl group-containing (meth) acrylate include cyclohexyl (meth)acrylate, methyl cyclohexyl (meth) acrylate, 3,3,5-trimethyl cyclohexyl (meth) acrylate, t-butyl cyclohexyl (meth)acrylate, cyclohexyoxy ethyl (meth)acrylate, tricyclodecyl (meth)acrylate, and isobornyl (meth)acrylate. Among these, cyclohexyl (meth) acrylate and 3,3,5-trimethyl cyclohexyl (meth)acrylate are preferable. It is preferable for the cycloalkyl group to have 6 to 9 carbon atoms. If the cycloalkyl group has 6 to 9 carbon atoms, the water solubility is little impeded even in cases where a larger amounts are introduced, and obtaining the (meth)acrylate is easy.

When the proportion of the constituent unit derived from the first cycloalkyl (meth)acrylate included in the polymer chain A is less than 20 mass %, the effect is not exhibited. Meanwhile, when 60 mass % is exceeded, there are cases where the solubility is lowered remarkably. It is preferable for the proportion of the constituent unit derived from the first cycloalkyl (meth)acrylate included in the polymer chain A to be 30 mass % to 50 mass %.

The polymer chain A includes a constituent unit derived from (meth)acrylic acid. The carboxyl group in the constituent unit is ionized by being neutralized, and the polymer chain A is dissolved in water. When the proportion of the constituent unit derived from (meth)acrylic acid included in the polymer chain A is less than 10 mass %, there are cases where the polymer chain A does not dissolve in water. Meanwhile, when 35 mass % is exceeded, the hydrophilicity of the polymer chain A rises excessively, and there are cases where the waterproofness of the obtained printed matter is lowered remarkably. It is preferable for the proportion of the constituent unit derived from the (meth)acrylic acid included in the polymer chain A to be 15 to 25 mass %.

The polymer chain A includes a "constituent unit derived from another (meth)acrylic acid". Specific examples of the other (meth)acrylate include aliphatic alkyl (meth)acrylates such as methyl (meth)acrylate, butyl (meth)acrylate, dodecyl (meth)acrylate; aromatic (meth)acrylates such as phenyl (meth)acrylate, benzyl (meth) acrylate; hydroxyl group-containing (meth) acrylates such as 2-hydroxyethyl (meth)acrylate, 2-hydroxypropyl (meth)acrylate; ether group or chain-containing (meth)acrylates such as (poly)ethylene glycol monoalkyl ether (meth)acrylate; and amino group-containing (meth)acrylates such as dimethyl aminoethyl (meth)acrylate. It is possible for one type of the other (meth)acrylate to be used individually or for two or more types to be used in combination.

The number average molecular weight of the polymer chain A is 1,000 to 10,000, and 2,000 to 7,000 is preferable. When the number average molecular weight of the polymer chain A is less than 1,000, the capability as a polymer is not exhibited. Meanwhile, when the number average molecular weight of the polymer chain A exceeds 10,000, the proportion of the hydrophilic chain occupied in the pigment dispersant is too great, dissociation of the polymer chain B from the pigment is promoted, and there are cases where the dispersion stability of the pigment is lowered. The number average molecular weight of the polymer chain or polymer in the specification is the polystyrene converted molecular weight according to gel permeation chromatography (below, also referred to as "GPC").

Polymer Chain B

The polymer chain B is a water-insoluble polymer chain, and has adsorptivity with respect to the pigment. Therefore, the polymer chain B is adsorbed on the pigment and coats (encapsulates) the pigment by being deposited on the surface. Specific examples of the second cycloalkyl group-containing (meth)acrylate are the same as the specific examples of the above-described first cycloalkyl group-containing (meth) acrylate. It is preferable for the proportion of the constituent unit derived from the second cycloalkyl(meth)acrylate included in the polymer chain B to be 30 mass % to 70 mass %, and 40 mass % to 60 mass % is more preferable.

Specific examples of the vinyl monomer having an aromatic ring include styrene, vinyl toluene, and vinyl naphthalene. Specific examples of the (meth)acrylate having an aromatic ring include phenol (meth)acrylate, naphthoxy (meth) acrylate, benzyl (meth) acrylate, phenoxyethyl (meth)acrylate, and paracumyl phenol ethylene oxide-modified (meth) acrylate. It is preferable for the proportion of the vinyl monomer having an aromatic ring or the constituent unit derived from (meth)acrylate included in the polymer chain B to be 30 mass % to 70 mass %, and 40 mass % to 60 mass % is more preferable.

Because the polymer chain B is softened, and a functional group such as a hydroxyl group is introduced, it is preferable for the above-described "other constituent unit derived from (meth)acrylate" to be included in the polymer chain B.

The number average molecular weight of either the graft copolymer or the block copolymer used as the pigment dispersant is 2,000 to 20,000, 5,000 to 15,000 is preferable, and 7,000 to 12,000 is more preferable. When the number average molecular weight is less than 2,000, the function as a pigment dispersant is lowered and the dispersion stability is not maintained. Meanwhile, when the number average molecular weight exceeds 20,000, there are cases where the viscosity of the aqueous pigment dispersion liquid increases and one molecular chain is adsorbed on a plurality of pigment particles, and the dispersion does not progress.

When the proportion of the polymer chain A that is the hydrophilic chain included in the graft copolymer and the block copolymer becomes excessively small, the pigment dispersant becomes insoluble in water and precipitates. Meanwhile, when proportion of the polymer chain A becomes excessively large, the waterproofness of the recorded printed matter is lowered, and the absorptivity with respect to the pigment is lowered. When the proportion of the polymer chain B that is the hydrophobic chain included in the graft copolymer and the block copolymer becomes excessively small, the pigment dispersant becomes stable and the pigment is not adsorbed. Meanwhile, when the proportion of the polymer chain B becomes excessively large, the pigment dispersant becomes insoluble in water and is separated. Accordingly, the mass ratio of the polymer chain A and the polymer chain B is A:B=30-70:70-30, 40-60:60-40 is preferable, and 40-50:50-40 is more preferable.

It is possible to use a pigment coated on a water-insoluble polymer in the color ink composition of the invention.

The water-insoluble polymer is a polymer obtained by polymerization by a solution polymerization method using at least a polymerizable unsaturated monomer and a polymerization initiator, and the water-insoluble polymer refers to a polymer for which the solubility with respect to 100 g of water at 25° C. after neutralization is less than 1 g.

Examples of the polymerizable unsaturated monomer include vinyl aromatic hydrocarbons, methacrylic acid esters, methacrylamides, alkyl substituted methacrylamides, anhydrous maleic acid, vinyl cyanide compounds, methylvinyl ketones, and vinyl acetates. Specific examples include styrene, α-methylstyrene, vinyl toluene, 4-t-butylstyrene, chlorostyrene, vinyl anisole, vinyl naphthalene, methyl methacrylate, ethyl methacrylate, isopropyl methacrylate, n-butyl methacrylate, isobutyl methacrylate, n-amyl methacrylate, isoamyl methacrylate, n-hexyl methacrylate, 2-ethyl hexyl methacrylate, octyl methacrylate, decyl methacrylate, dodecyl methacrylate, octadecyl methacrylate, cyclo hexyl methacrylate, phenyl methacrylate, benzyl methacrylate, glycidyl methacrylate, acrylonitryl, and methacrylonitryl, and it is possible for these to be used individually or for two or more types to be used in mixture.

It is preferable that the water-insoluble polymer includes a monomer having a hydrophilic group and a monomer having a salt generating group in order to contribute glossiness to the printed image.

Examples of the monomer having a hydrophilic group include polyethylene glycol monomethacrylate, polypropylene glycol monomethacrylate, and ethylene glycol-propylene glycol monomethacrylate, and it is possible to use these singly or to use two or more types in a mixture. In particular, the glossiness of a printed image is further improved by using a monomer component that configures a branched chain, such as polyethylene glycol (2-30) monomethacrylate, polyethylene glycol (1-15)-propylene glycol (1-15) monomethacrylate, polypropylene glycol (2-30) methacrylate, methoxypolyethylene glycol (2-30) methacrylate, methoxypolytetramethylene glycol (2-30) methacrylate, and methoxy (ethylene glycol-propylene glycol copolymer) (1-30) methacrylate.

The monomer having a salt-generating group is an acrylic acid, methacrylic acid, styrene carboxylic acid, maleic acid or the like, and it is possible to use these singly or to use two or more types in a mixture.

It is further possible to use together a macromonomer, such as a styrene macromonomer and a silicone macromonomer having a polymerizable functional group on one terminal and another monomer.

The organic pigment coated by the water-insoluble polymer is obtained by a phase transfer emulsification method. That is, it is possible to obtain a water dispersion by preparing an oil-in-water drop type dispersant by dissolving the water-insoluble polymer in an organic solvent such as methanol, ethanol, isopropanol, n-butanol, acetone, methyl ethyl ketone, and dibutylethyl, adding an organic pigment to the obtained solution, adding a neutralizing agent and water and performing kneading and a dispersion treatment, and removing the organic solvent from the obtained dispersion. It is possible for the kneading and dispersion treatment use a ball mill, a roll mill, a bead mill, a high pressure harmonizer, a high speed agitation dispersion apparatus or the like.

It is preferable that the weight average molecular weight of the coated water-insoluble polymer is 10000 to 150000 from the point of a coloring agent, in particular a pigment, being stably dispersed. It is possible for the weight average molecular weight to be measured using a molecular weight analysis method according to gel permeation chromatography (GPC).

Examples of the self dispersing pigment, resin-coated pigment, and water-insoluble polymer coated pigment of the color ink composition include, in addition to pigments such as pigment yellow, pigment red, pigment violet, pigment blue, and pigment black described in a color index, pigments such as phthalocyanine-based, azo-based, anthraquinone-based, azomethine-based, and condensed ring-based pigments. Examples include organic pigments such as yellow No. 4, No. 5, No. 205, No. 401; orange No. 228, No. 405, blue No. 1, and No. 404, and inorganic pigments such as titanium oxide, zinc oxide, zirconium oxide, iron oxide, ultramarine blue, Prussian blue, and chrome oxide, and more specific examples include C.I. Pigment Yellow 1, 3, 12, 13, 14, 17, 24, 34, 35, 37, 42, 53, 55, 74, 81, 83, 95, 97, 98, 100, 101, 104, 108, 109, 110, 117, 120, 128, 138, 150, 153, 155, 174, 180, 198, C.I. Pigment Red 1, 3, 5, 8, 9, 16, 17, 19, 22, 38, 57:1, 90, 112, 122, 123, 127, 146, 184, C.I. Pigment Violet 1, 3, 5:1, 16, 19, 23, 38, and C. I. Pigment Blue 1, 2, 15, 15:1, 15:2, 15:3, 15:4, 16. In particular, it is preferable that the organic pigment included in the yellow ink composition includes at least one type selected from a group consisting of C.I. Pigment Yellow 74, 109, 110, 128, 138, 147, 150, 155, 180 and 188, the organic pigment included in the magenta ink composition includes at least one type selected from a group consisting of C.I. Pigment Red 122, 202, 207, 209, and C.I. Pigment Violet 19, the organic pigment included in the cyan ink composition includes at least one type selected from a group consisting of C.I. Pigment Blue 15, 15:1, 15:2, 15:3, 15:4 and 16.

Meanwhile, the self dispersing pigment of the color ink composition is manufactured by a hydrophilic group being bonded to the pigment surface via a phenyl group. As a surface treatment means that bonds the functional group that is the hydrophilic group or a salt thereof to the pigment surface through the phenyl group, it is possible to apply various well-known surface processing means and examples include a method of bonding the hydrophilic group through the phenyl group by bonding sulfanilic acid, p-amino benzoic acid, 4-amino salicylic acid and the like to the pigment surface.

It is also possible to use a commercially available product as the self dispersing pigment of the color ink composition, and example include CAB-O-JET 250C, CAB-O-JET 260M, and CAB-O-JET 270Y (all manufactured by Cabot Corporation).

Meanwhile, the resin-coated pigment of the color ink composition is obtained by the manufacturing method disclosed in JP-A-2013-166867, and it is possible for the water-insoluble polymer coated pigment and self dispersing pigment to use a material obtained by the manufacturing method disclosed in JP-A-2011-178916.

Although the resin-coated pigment and the water-insoluble polymer pigment are also referred to as encapsulated pigments, cases where the entire pigment surface is coated and cases where at least a portion of the surface is coated are both included.

It is preferable that the self dispersing pigment, resin-coated pigment, and water-insoluble polymer coated pigment in the color ink composition are included at 3 wt % or more, similarly to the case of the black ink composition. In cases where the pigment concentration is 3 wt % or more, the recording material has high color development.

For the self dispersing pigment, the resin-coated pigment and the water-insoluble polymer coated pigment in the color ink composition, similarly to the case of the black ink composition, from the viewpoint of reducing the precipitation of the pigment, the volume average particle diameter (D50) of the pigment particle diameter distribution measured with a dynamic light scattering method satisfies a condition of 50 nm<D50<150 nm, and the maximum particle size of the pigment particle diameter distribution is 200 nm or less. The particle size of the pigment is comparatively small, and variations in the particle size are reduced and precipitation of the pigment is lowered. It is still more preferable that the particle size of the pigment satisfies a condition of 60 nm<D50<80 nm. It is possible to further suppress precipitation of the pigment.

Here, D50 refers to the median diameter. The median diameter is the diameter at which the product frequency on the large and small sides becomes equivalent when the particle size is divided by two in a distribution (product frequency) for each particle size in a powder. Specifically, the median diameter is obtained from the product distribution in a case where the particle size is measured volumetrically by a Microtrac (laser diffraction method), and, for example, and may be measured with a UPA-EX by Nikkiso Co., Ltd.

In the invention, even in cases where the pigment is coated with a resin as in the resin-coated pigment or water-insoluble polymer coated pigment, it is possible for the measurement value of D50 according to the dynamic light scattering method to be applied as is.

It is preferable that the color ink composition according to the invention, similarly to the case of the black ink composition, includes at least 80 wt % to 10 wt % of water, a water soluble organic solvent and a surfactant. Specific examples and the addition amounts thereof may be the same as the case of the black ink composition.

It is further possible to add, as necessary, a pH adjuster, a pH buffer, an antifoaming agent, an antioxidant, an ultraviolet ray absorber, a preservative and fungicide and the like to the color ink composition, similarly to the case of the black ink composition. The specific examples thereof may be the same as the case of the black ink composition.

Next, the resin emulsion will be described. The resin emulsion has an action of improving the fixing properties of the image part of the recording material, because the coloring agent is fixed to the recording medium by the resin particles fusing to each other and the resin particles and the coloring component fusing to one another.

It is preferable that the resin particles are one type or two or more types selected form a group consisting of an acrylic resin, methacrylic resin, a styrene resin, a urethane resin, an acrylamide resin and an epoxy resin. These resins may be used as a homopolymer or may be used as a copolymer.

In the invention, it is possible for a single particle structure to be used as the resin particles. Meanwhile, in the invention, it is possible for resin particles having a core-shell structure formed from a core portion and a shell portion surrounding the core to be used. In the invention, the "core-shell structure" signifies "a form where two or more types of polymer with different compositions are present phase separated in the particles". Accordingly, not only a form where the shell portion completely coats the core portion, but also a form may be used where a portion of the core portion is coated. A portion of the shell portion polymer may form a domain in the core particle. The core-shell core structure further include one or more layers between the core portion and the shell portions, thereby having a multilayer structure with 3 or more layers including layers with different constitutions.

The resin particles used in the invention may be obtained by a known emulsion polymerization. That is, it is possible for the resin particles to be obtained by emulsion polymerization of an unsaturated vinyl monomer in water in which a polymerization catalyst and an emulsifier are present.

Examples of the unsaturated vinyl monomer include acrylic acid ester monomers generally used in emulsion polymerization, methacrylic acid ester monomers, aromatic vinyl monomers, vinyl ester monomers, vinyl cyanide compound monomers, halogenized monomers, olefin monomers and diene monomers.

Further specific examples include acrylic acid esters such as methyl acrylate, ethyl acrylate, isopropyl acrylate, n-butyl acrylate, isobutyl acrylate, n-amyl acrylate, isoamyl acrylate, n-hexyl acrylate, 2-ethyl hexyl acrylate, octyl acrylate, decyl acrylate, dodecyl acrylate, octadecyl acrylate, cyclo hexyl acrylate, phenyl acrylate, benzyl acrylate, and glycidyl acrylate; methacrylic acid esters such as methyl methacrylate, ethyl methacrylate, isopropyl methacrylate, n-butyl methacrylate, isobutyl methacrylate, n-amyl methacrylate, isoamyl methacrylate, n-hexyl methacrylate, 2-ethyl hexyl methacrylate, octyl methacrylate, decyl methacrylate, dodecyl methacrylate, octadecyl methacrylate, cyclohexyl methacrylate, phenyl methacrylate, benzyl methacrylate, and glycidyl methacrylate; and vinyl esters such as vinyl acetate; vinyl cyanide compounds such as acrylonitrile, and methacrylonitrile; halogenized monomers such as vinylidene chloride, and vinyl chloride; aromatic vinyl monomers such as styrene, α-methyl styrene, vinyl toluene, t-butyl styrene, chlorostyrene, vinyl anisole, vinyl naphthalene; olefins such as ethylene, propylene; dienes such as butadiene, and chloroprene; vinyl monomers such as vinyl ether, vinyl ketone, and vinyl pyrrolidone; unsaturated carboxylic acids such as acrylic acid, methacrylic acid, itaconic acid, fumaric acid, and maleic acid; acrylamides such as acryl amide and N,N'-dimethyl acryl amide; and hydroxyl group-containing monomers such as 2-hydroxyethyl acrylate, 2-hydroxypropyl acrylate, 2-hydroxyethyl methacrylate, and 2-hydroxypropyl methacrylate.

In the invention, it is possible to use ones having a structure cross-linked by a crosslinkable monomer having two or more polymerizable double bonds as the monomer derived molecule. Examples of the cross-linkable monomer having two or more polymerizable double bonds include diacrylate compounds such as polyethylene glycol diacrylate, triethylene glycol diacrylate, 1,3-butylene glycol diacrylate, 1,6-butylene glycol diacrylate, 1,6-hexane diol diacrylate, neopentyl glycol diacrylate, 1,9-nanone diol diacrylate, polypropylene glycol diacrylate, 2,2'-bis(4-acryloxy propyloxy phenyl)propane, and 2,2'-bis(4-acryloxy diethoxy phenyl)propane, triacrylate compounds such as trimethylol propane triacrylate, trimethylol ethane triacrylate, and tetramethylol methane triacrylate, tetraacrylate compounds such as ditrimethylol tetraacrylate, and tetramethylol methane tetraacrylate, pentaerythritol tetraacrylate, hexaacrylate compounds such as dipentaerythritol hexaacrylate, dimethacrylate compounds such as ethylene glycol dimethacrylate, diethylene glycol dimethacrylate, triethylene glycol dimethacrylate, polyethylene glycol dimethacrylate, 1,3-butylene glycol dimethacrylate, 1,4-butylene glycol dimethacrylate, 1,6-hexane diol dimethacrylate, neopentyl glycol dimethacrylate, dipropylene glycol dimethacrylate, polypropylene glycol dimethacrylate, polybutylene glycol dimethacrylate, and 2,2'-bis(4-methacryloxy diethoxyphenyl)propane, and trimethacrylate compounds such as trimethylol propane trimethacrylate, and trimethylol ethane trimethacrylate, methylene bisacrylamide, and divinyl benzene, and it is possible to use these individually or to use two or more types in mixture.

It is possible to use the polymerization initiator, the emulsifier, and the molecular weight regulator during emulsion polymerization in accordance with normal methods.

The same polymerization initiators as those used in ordinary radical polymerization are used, and examples thereof include potassium persulfate, ammonium persulfate, hydrogen peroxide, azobisisobutyronitrile, benzoyl peroxide, dibutyl peroxide, peracetic acid, cumene hydroperoxide, hydroxy-t-butyl peroxide, and hydroxy para menthane peroxide. In particular, similarly to the above description, in a case when the polymerization reaction is performed in water, a water soluble polymerization initiator is preferable.

Examples of the emulsifier include, in addition to sodium lauryl sulfate, generally used anionic surfactants, nonionic surfactants, or amphoteric surfactants, and mixtures thereof. It is possible to use these singly or to use a two or more types as a mixture.

In a case of preparing the resin particles by emulsion polymerization, particularly in cases where the polymer emulsion configured from anionic resin particles is prepared by emulsion polymerization, the pH inclines to the acidic side because a negative polar group such as a carboxyl group or a sulfonate group is present in the surface of the resin particles, and viscosity increases or aggregation easily occurs. Thus, neutralization is normally performed with a basic substance. It is possible for ammonia, organic amines, inorganic hydroxides and the like to be used as the basic substance. From the viewpoint of long term storage stability and discharge stability of the polymer emulsion and the aqueous ink composition, among these, a monovalent inorganic hydroxide (potassium hydroxide, sodium hydroxide, lithium hydroxide) is particularly preferable. The addition amount of the neutralizing agent is determined, as appropriate, so that the pH of the polymer emulsion is in a range of 7.5 to 9.5, and a range of 7.5 to 8.5 is preferable.

From the viewpoint of long term storage stability and discharge stability of the ink composition, the particle diameter of the preferable resin particles in the invention is in a range of 5 nm o 400 nm, and a range of 50 nm to 200 nm is more preferable.

Although the addition amount of these resin emulsions may be determined, as appropriate, in consideration of the fixing properties, including a solid content of 2 wt % or more in each ink composition is preferable.

Above, according to the embodiment, it is possible for the following effects to be obtained.

Because an appropriate fiber ratio and fiber diameter in the fiber member are stipulated with respect to the fiber member and ink accommodated in the cartridges 4 and 5, and an appropriate maximum particle diameter in the pigment in the liquid is stipulated, precipitation of the pigment is suppressed. In so doing, when the cartridges 4 and 5 are mounted to the ink jet printer 10, and an image is formed by discharging ink accommodated in the cartridges 4 and 5, it is possible for image unevenness to be reduced and the image quality to be improved.

EXAMPLES

Next, specific examples according to the invention will be described.

1. Manufacturing of Liquid Accommodating Container (Cartridge)

First, as shown in Table, liquid accommodating containers (Examples 1 to 6 and Comparative Examples 1 to 4) in which the fiber member and ink stipulated by each constitution is accommodated was manufactured. The materials in the table are prepared as follows.

Preparation of Self Dispersing Pigment Dispersion Liquid 20 g of 5170 (trade name, manufactured by Degussa AG) which is a commercially available carbon black) was mixed with 500 g of water, and dispersed for 5 minutes with a domestic mixer. The obtained liquid was introduced to 3 L glass container with an attached stirring device, and an ozone-containing gas with an ozone density of 8 mass % was introduced at 500 mL/minute while stirring with a stirring apparatus. In this case, the ozone was generated by an ozone generator using an electrolytic generation-type ozonizer manufactured by Permelec Electrode Ltd. The obtained dispersion raw slurry was filtered with a glass fiber filter paper GA-100 (trade name, manufactured by Advantec MFS, Inc.), and concentrated until the solid content concentration reached 20 mass % while adjusting to the pH to 9 by adding 0.1 N potassium hydroxide, thereby obtaining a self dispersing black pigment dispersion liquid.

Preparation of Water-Insoluble Polymer Coated Resin 20 parts by mass of an organic solvent (methyl ethyl ketone), 0.03 parts by mass of a polymerization chain transfer agent (2-mercaptoethanol), a polymerization initiator, 15 parts by mass of polypropylene glycol monomethacrylate (propyleneoxide=9), 15 parts by mass of poly (ethylene glycol-propylene glycol) monomethacrylate (propylene oxide group=7, ethylene oxide group=5), 12 parts by mass of methacrylic acid, 50 parts by mass of a styrene monomer, 10 parts by mass of a styrene macromer, 10 parts benzyl methylacrylate were used and introduced in a reaction vessel in which nitrogen gas conversion was sufficiently performed, and polymerized under stirring at 75° C., 0.9 parts by mass of 2,2'-azobis(2,4-dimethyl valeronitrile) dissolved in 40 parts by mass of methyl ethyl ketone with respect to 100 parts by mass of the monomer component was added and matured for 1 hour at 80° C., thereby obtaining a polymer solution.

7.5 parts by mass of the obtained water-insoluble polymer was dissolved in 45 parts by mass of methyl ethyl ketone, the salt generating group was neutralized by adding a predetermined amount of a 20% sodium hydroxide solution (neutralizing agent) thereto, 20 parts by mass of C.I. Pigment Yellow 74 was further added as a pigment, and the obtained mixture was kneaded for 2 hours with a bead mill. After 120 parts by mass of ion exchange water was added to the obtained kneaded material and stirred, the methyl ethyl ketone was removed under reduced pressure at 6° C., and the yellow pigment dispersion liquid 1 with a solid content concentration of 20 mass % was obtained by further removing a portion of the water.

Adjustment of Resin Emulsion 900 g of ion exchange water and 1 g of sodium lauryl sulfate were added to a reaction vessel provided with a stirring apparatus, a reflux condenser, a dropping device, and a thermometer, and the temperature was raised to 70° C. while performing nitrogen substitution under stirring. The internal temperature was held as 70° C., and after 4 g of potassium persulfate was added as a polymerization initiator and dissolved, an emulsion prepared in advance by adding 20 g of acrylamide, 365 g of styrene, 545 g of butyl acrylate and 30 g of methacrylic acid to 450 g of ion exchange water and 3 g of sodium lauryl sulfate under stirring was continuously added dropwise over 4 hours in a reaction liquid. After completion of the dropwise addition, the mixture was matured for 3 hours. After cooing the obtained resin emulsion to room temperature, the emulsion was adjusted to a solid content of 40 mass % and a pH of 8 by adding ion exchange water and a sodium hydroxide solution. The glass-transition temperature of the resin particles obtained aqueous emulsion is −6° C.

Adjustment of Resin-Coated Pigment Dispersion Liquid 100 parts of BTG and 600 parts of a solution of macromonomer MM-1 were added to a reaction vessel and heated to 80° C. 200 parts of styrene (below, denoted as "St"), 100 parts of butylacrylate (below, denoted as "BA"), and 5 parts of t-butyl peroxy-2-ethylhexanoate (below, denoted as "PBO") were added to a separate reaction vessel and well stirred, thereby preparing a monomer solution. After ½ of the monomer solution was added to a reaction vessel A, the remaining ½ was slowly added dropwise over 1 hour. After finishing dropwise addition, the polymerization was allowed to proceed for 3 hours. 2.5 parts of PBO was added and heated to 85° C., and further polymerized for 4 hours. The solution was neutralized by adding 32.3 parts of potassium hydroxide (KOH) and 467.7 parts of water, thereby obtaining a polymer solution containing a polymer (copolymer CP-1). The solid content concentration was measured by sampling the obtained polymer solution, and the polymerization conversion ratio was converted from the non-volatile content to 100%. The Mn of the copolymer CP-1 is 15,900, the Mw is 38,500, and the PDI is 2.42. Peaks in the macromonomer-derived molecular weight were not observed. After the molecular weight was measured using a UV detector, the MN was 15,600, Mw was 39,100, and the PDI was 2.51. This is thought to be because the monomer component that configures the polymer chain B includes an aromatic ring, and significant absorption is observed. It is thought that the molecular weight increases by polymerizing the macromonomer MM-1 and the monomer component that configures the polymer chain B, thereby obtaining a graft copolymer. Even in the synthesis example below, it was confirmed that the obtained copolymer 1 became a graft copolymer by performing similar measurement. Based on the results of the solid content concentration measurement, ion exchange water was added to the obtained polymer solution, thereby adjusting the solid content concentration to 30%.

233.3 parts of the polymer solution containing the obtained copolymer, 70 parts of diethylene glycol monobutyl ether, and 311.7 parts of water were mixed, thereby obtaining a slightly cloudy semitransparent solution. 350 parts of an azo-based yellow pigment PY-74 (trade name, "Seika Fast Yellow 2016G") was added to the solution, and a mill base was prepared by stirring for 30 minutes using a disperser. A horizontal type medium disperser (trade name "Dyno mill 0.6 liter, model ECM, manufactured by Shin Maru Enterprises, Ltd., zirconia beads, diameter 0.5 mm) was used, dispersion treatment performed at a speed of 10 m/s, and the pigment sufficient dispersed in the mill base. Thereafter, the pigment concentration was made 18% by adding 316 parts of water. The mill base removed from the dispserser was subjected to centrifugation (7500 rpm, 20 minutes), then filtered with a 10 μm membrane filter. A resin-coated pigment dispersion liquid for ink jet use with a pigment concentration of 14% was obtained by diluting with water.

1. Adjustment of Liquid Composition

Each ink composition was prepared by blending each component according to the constitutions in A in Table and filtering with a 10 μm membrane filter. In a state of a liquid composition in which the surfactant (polyethylene oxide octane acid ester) in B in Table is included in the composition, a fiber member was also accommodated in the accommodation container.

Measurement Method of Pigment Average Particle Diameter

The concentration was adjusted so that the maximum absorption ABS approaches 1 by diluting the liquid composition with water using a volumetric flask. As dilution rates, 2000 time for cyan and magenta, 4000 times for yellow and 5000 times for black were used as a guide. The concentration was 0.2 to 0.5 g/l. The diluting liquid was introduced to the measurement portion of a Nanotrac particle size analyzer "UPA-EX", dynamic measurement was performed for n=3 times, and the average value thereof was acquired as measurement data. The measurement conditions were a solvent of water (refractive index 1.31), a particle refractive index of 1.51, and the sensitivity and filter were standard.

2. Evaluation

Next, the ink supply speed, effective ink amount, printing unevenness, and discharge characteristics were evaluated for Examples 1 to 6 and Comparative Examples 1 to 4. The respective evaluation methods are as follows.

A. Evaluation Method of Ink Supply Speed

Ink was continuously discharged (continuous printing, solid pattern) with an ink jet printer to which the cartridge was mounted, and the occurrence frequency of ink dot omissions was evaluated. In so doing, it is possible for the supply speed of ink from the cartridge to the discharging head to be evaluated. Because the ink is discharged from the discharging head as predetermined as long as the supply speed of ink from the cartridge to the discharging head is as predetermined, ink dot omissions do not occur. Meanwhile, in cases where the supply speed of ink from the cartridge to the discharging head is slow, because the supply of ink with respect to the discharge operation of the discharging head is delayed, ink dot omissions easily arise. In the evaluation, cases where the frequency of ink dot omission was low (within permitted range) were given the rating A or B. Rating A indicates a better evaluation result over rating B. Meanwhile, cases where the frequency of ink dot omissions was high (outside permitted range) were given the rating C.

In more detail, rating A is no occurrence of dot omissions when Japanese Standards Association SCID sample "Bicycle" A4 data printing speed measurement data is continuously printed until the ink amount in the cartridge reaches an end state form a full state. Rating B is a dot omission occurrence rate of less than 1% when Japanese Standards Association SCID sample "Bicycle" A4 data printing speed measurement data is continuously printed until the ink amount in the cartridge reaches an end state from a full state. (Definition of dot omission occurrence rate: number of dot omission/total number of nozzles×100). Rating C is a dot omission occurrence rate of 1% or more when Japanese Standards Association SCID sample "Bicycle" A4 data printing speed measurement data is continuously printed until the ink amount in the cartridge reaches an end state from a full state. (Definition of dot omission occurrence rate: number of dot omission/total number of nozzles×100).

B. Evaluation Method of Ink Remainder

The Japanese Standards Association SCID sample "Bicycle" A4 data printing speed measurement data is printed until the cartridge ink amount reaches the end state from the full state on A4 size sheets using an ink jet printer to which the cartridge is mounted. Thereafter, the weight of the cartridge used in the evaluation was measured, and the weight thereof recorded (weight A). The cartridge for which the weight was measured was disassembled to its constituent components, and the ink attached to each component was cleaned. The weight of each component after cleaning was measured, and the weight thereof was recorded (weight B). The weight B was subtracted from the weight A, yielding the ink remainder. Cases where the ink remainder was sufficiently low were given the rating A or B. Rating A indicates a better evaluation result over rating B. Meanwhile, cases where the ink remainder was high were given the rating C.

In more detail, rating A is an ink remainder of less than 15 wt % of the ink introduction amount. Rating B is an ink remainder of 15 wt % or more to less than 20 wt % of the ink introduction amount. Rating C is an ink remainder of 20 wt % or more of the ink introduction amount.

C. Evaluation Method of Printing Unevenness

Printing unevenness (color difference) within a pass of an image formed in one pass (discharging head driven once in the main scanning direction) printed on the same sheet using an ink jet printer to which the cartridge is mounted is evaluated. In this case, a cartridge in which precipitation was caused by a centrifugal accelerator was used (centrifugal acceleration conditions: 80G, 60 hours). Precipitation of the pigment is promoted by using a centrifugally accelerated cartridge. Accordingly, in a case where the image is formed using a cartridge in which ink in which the pigment easily precipitates is accommodated, printing unevenness easily occurs and the color difference becomes great. Meanwhile, in a case where the image is formed using a cartridge in which ink in which the pigment does not easily precipitate is accommodated, printing unevenness is low and the color difference is reduced. In the evaluation, cases where the printing unevenness was lower than a standard were given the rating A or B. Rating A indicates a better evaluation result over rating B. Meanwhile, cases where the printing unevenness was higher than a standard were given the rating C.

In more detail, rating A is a color difference ΔE00 of less than 3. Rating B is a color difference ΔE00 of 3 or more to less than 5. Rating C is a color difference ΔE00 of 5 or more.

D. Evaluation Method of Discharge Characteristics

Ink discharge was performed a stipulated number of times from the discharging head using the ink jet printer to which the cartridge is mounted and the weight of the discharged ink is measured. In so doing, it is possible to determine whether the necessary amount of ink stipulated is able to be discharged. For example, in a case where the viscosity of the ink is greater than the stipulated viscosity, it is difficult to discharge the stipulated ink amount, and the discharge characteristics are lowered. In the evaluation, cases where the discharge characteristics were good were given the rating A or B. Rating A indicates a better evaluation result over rating B. Meanwhile, cases where the discharge characteristics were at or below a regulation were given the rating C.

In more detail, rating A is an ink weight of less than 3 wt % with respect to the target weight. Rating B is an ink weight of 3 wt % or more to less than 5 wt % with respect to the target weight. Rating C is an ink weight of 5 wt % or more with respect to the target weight.

3. Evaluation Results

The ink supply speed, effective ink amount, printing unevenness, and discharge characteristics were evaluated in the examples and comparative examples. The evaluation results are as in Table.

TABLE

| Ink Composition/mass % | Example 1 | Example 2 | Example 3 | Example 4 | Example 5 |
|---|---|---|---|---|---|
| Self Dispersing Pigment (Solid Content) | 5.0 | — | — | 5.0 | 5.0 |
| Resin-coated Pigment (Solid Content) | — | 5.0 | — | — | — |
| Water-insoluble Polymer coated Pigment (Solid Content) | — | — | 5.0 | — | — |
| Resin Emulsion | 3.0 | — | — | 3.0 | 3.0 |
| Glycerin | 7.0 | 7.0 | 7.0 | 7.0 | 7.0 |

TABLE-continued

| | | | | | |
|---|---|---|---|---|---|
| Trimethyl Glycerin | 5.0 | 5.0 | 5.0 | 5.0 | 5.0 |
| Triethylene Glycol Monobutyl Ether | 3.5 | 3.5 | 3.5 | 3.5 | 3.5 |
| 1,2-hexane diol | 1.0 | 1.0 | 1.0 | 1.0 | 1.0 |
| Olfine E1010 | 0.5 | 0.5 | 0.5 | 0.5 | 0.5 |
| S104PG50 (Acetylene-based Surfactant) | 0.5 | 0.5 | 0.5 | 0.5 | 0.5 |
| Triethanol Amine | 1.0 | 1.0 | 1.0 | 1.0 | 1.0 |
| Pure Water | Remainder | Remainder | Remainder | Remainder | Remainder |
| Fiber Member | Example 1 | Example 2 | Example 3 | Example 4 | Example 5 |
| Fiber Rate/% | 10 | 10 | 10 | 5 | 25 |
| Fiber Diameter/μm | 30 | 30 | 30 | 40 | 20 |
| Pigment Ink Particle Diameter D50/nm | 60 | 60 | 60 | 60 | 60 |
| Pigment Ink Maximum Particle Diameter/nm | 170 | 170 | 170 | 170 | 170 |
| Evaluation | Example 1 | Example 2 | Example 3 | Example 4 | Example 5 |
| Ink Supply Speed (negative pressure) | A | A | A | A | B |
| Effective Ink Amount (Ink Remainder) | A | A | A | B | A |
| Printing Unevenness (Color difference within pass) | A | A | A | A | A |
| Discharge Characteristics (Ink Viscosity) | A | A | A | A | A |

| Ink Composition/mass % | Example 6 | Comparative Example 1 | Comparative Example 2 | Comparative Example 3 | Comparative Example 4 |
|---|---|---|---|---|---|
| Self Dispersing Pigment (Solid Content) | 5.0 | 5.0 | 5.0 | 5.0 | 5.0 |
| Resin-coated Pigment (Solid Content) | — | — | — | — | — |
| Water-insoluble Polymer coated Pigment (Solid Content) | — | — | — | — | — |
| Resin Emulsion | 3.0 | 3.0 | 3.0 | 3.0 | 3.0 |
| Glycerin | 7.0 | 7.0 | 7.0 | 7.0 | 7.0 |
| Trimethyl Glycerin | 5.0 | 5.0 | 5.0 | 5.0 | 5.0 |
| Triethylene Glycol Monobutyl Ether | 3.5 | 3.5 | 3.5 | 3.5 | 3.5 |
| 1,2-hexane diol | 1.0 | 1.0 | 1.0 | 1.0 | 1.0 |
| Olfine E1010 | 0.5 | 0.5 | 0.5 | 0.5 | 0.5 |
| S104PG50 (Acetylene-based Surfactant) | 0.5 | 0.5 | 0.5 | 0.5 | 0.5 |
| Triethanol Amine | 1.0 | 1.0 | 1.0 | 1.0 | 1.0 |
| Pure Water | Remainder | Remainder | Remainder | Remainder | Remainder |
| Fiber Member | Example 6 | Comparative Example 1 | Comparative Example 2 | Comparative Example 3 | Comparative Example 4 |
| Fiber Rate/% | 10 | 40 | 3 | 10 | 10 |
| Fiber Diameter/μm | 30 | 5 | 50 | 30 | 30 |
| Pigment Ink Particle Diameter D50/nm | 80 | 60 | 60 | 120 | 20 |
| Pigment Ink Maximum Particle Diameter/nm | 200 | 170 | 170 | 400 | 150 |
| Evaluation | Example 6 | Comparative Example 1 | Comparative Example 2 | Comparative Example 3 | Comparative Example 4 |
| Ink Supply Speed (negative pressure) | A | C | A | A | A |
| Effective Ink Amount (Ink Remainder) | A | A | C | A | A |
| Printing Unevenness (Color difference within pass) | B | A | A | C | A |
| Discharge Characteristics (Ink Viscosity) | A | A | A | A | C |

As shown in Table, the ink supply speed, effective ink amount, printing unevenness, and discharge characteristics were excellent with respect to all the evaluations for a cartridge of Examples 1 to 4 according to the invention. Meanwhile, in the cartridges of Comparative Examples 1 to 4, satisfactory results were not obtained. In Comparative Example 1, the fiber rate is high and the fiber diameter is small. In this case, because the porosity of the fiber held in the ink is low, the negative pressure in the discharging head lowers, and the supply of ink from the cartridge to the discharging head is delayed. Therefore, it becomes easier for the ink dot omissions to occur. In Comparative Example 2, the fiber rate is low and the fiber diameter is large. In this case, the porosity of the fibers increases excessively, thereby lowering the capillary action. Therefore, ink held in a comparatively distant location is not easily suctioned from the ink supply hole, thereby lowering the effective ink amount. In Comparative Example 3, because the maximum particle size of the pigment is larger than stipulated, the pigment easily precipitates. Therefore, a concentration distribution arises in the cartridge, and printing unevenness easily occurs. In Comparative Example 4, because the particle diameter of the pigment is smaller than stipulated, the surface area of the pigment increases, and the ink viscosity increases. In so doing, the resistance of the ink increases with respect to the driving of the discharging head, thereby lowering the discharge characteristics. In contrast, because the fiber rate and the fiber diameter are set within the stipulation, and the particle diameter of the pigment is set within the stipulation for Examples 1 to 4, it is possible to make the ink supply speed, effective ink amount, printing unevenness and discharge characteristics satisfactory.

The entire disclosures of Japanese Patent Application Nos. 2014-127926, filed Jun. 23, 2014 and No. 2015-119000, filed Jun. 12, 2015 are expressly incorporated by reference herein.

What is claimed is:

1. A liquid accommodating container in which a fiber member and a liquid are accommodated, wherein a fiber ratio of the fiber member is 5% or more to 30% or less, a fiber diameter of the fiber member is 10 μm or more to 50 μm or less, a volume average particle diameter (D50) of a pigment included in the liquid satisfies a condition of 50 nm<D50<150 nm; and a maximum particle diameter is 200 nm or less.

2. The liquid accommodating container according to claim 1, wherein the volume average particle diameter (D50) of the pigment satisfies a condition of 60 nm<D50<80 nm.

3. The liquid accommodating container according to claim 1, wherein the pigment is configured by any of a self dispersing pigment, a resin-coated pigment coated with a dispersion rein, and a water-insoluble polymer coated pigment.

4. The liquid accommodating container according to claim 1, wherein at least one type of organic solvent selected from glycerin, a pyrrolidone system, and a glycol system is included as the liquid.

* * * * *